US005504325A

United States Patent [19]

Talmon et al.

[11] Patent Number: 5,504,325

[45] Date of Patent: Apr. 2, 1996

[54] SYSTEM FOR MONITORING A MULTIPLICITY OF DOORS USING MULTIPLE OPTICAL TRANSCEIVERS MOUNTED ON EACH DOOR

[75] Inventors: Gad Talmon, Kiryat Ono; Zvi Dershowitz, Givat Shmuel, both of Israel

[73] Assignee: Elisra Electronic Systems Ltd., Bnei Brak, Israel

[21] Appl. No.: 235,422

[22] Filed: Apr. 28, 1994

[30] Foreign Application Priority Data

Apr. 28, 1993 [IL] Israel ..... 105543

[51] Int. Cl.[6] ..... H01J 40/14

[52] U.S. Cl. ..... 250/222.1; 340/555; 109/56

[58] Field of Search ..... 250/221, 222.1; 340/555, 556, 557, 541; 109/55, 56

[56] References Cited

U.S. PATENT DOCUMENTS

| | | | |
|---|---|---|---|
| 3,711,846 | 1/1973 | Schlisser et al. | 340/557 |
| 3,816,745 | 6/1974 | Primm | 250/221 |
| 3,875,403 | 4/1975 | Svensson | 250/209 |
| 3,987,428 | 10/1976 | Todeschini | 340/258 D |
| 4,266,124 | 5/1981 | Weber | 250/221 |
| 4,319,332 | 1/1982 | Mehnert | 364/516 |
| 4,324,977 | 4/1982 | Brauer | 250/222 R |
| 4,390,867 | 6/1983 | Queren | 340/542 |
| 4,583,082 | 4/1986 | Naylor | 340/545 |
| 4,594,581 | 6/1986 | Matoba | 340/531 |
| 4,650,990 | 3/1987 | Jönsson | 250/221 |
| 4,742,337 | 5/1988 | Haag | 340/556 |
| 4,812,810 | 3/1989 | Query | 340/545 |
| 4,841,283 | 6/1989 | Bubliewicz | 340/545 |
| 4,903,009 | 2/1990 | D'Ambrosia | 340/556 |
| 4,957,348 | 9/1990 | May . | |
| 4,965,551 | 10/1990 | Box | 340/545 |
| 4,976,337 | 12/1990 | Trett . | |
| 5,015,840 | 5/1991 | Blau | 250/221 |
| 5,063,288 | 11/1991 | Hsu | 250/221 |
| 5,111,184 | 5/1992 | Heaton | 340/542 |
| 5,135,386 | 7/1992 | Swanic | 340/541 |
| 5,138,299 | 8/1992 | Patten | 340/545 |
| 5,150,100 | 9/1992 | Black et al. | 340/555 |
| 5,219,386 | 6/1993 | Kletzmaier et al. | 70/277 |

*Primary Examiner*—Edward P. Westin
*Assistant Examiner*—Stephen Calogero
*Attorney, Agent, or Firm*—Darby & Darby

[57] ABSTRACT

A system for monitoring a multiplicity of doors including at least two optical transceivers mounted on each of the multiplicity of doors and communication apparatus for communicating with the optical transceivers mounted on each of the multiplicity of doors thereby to verify their position, the communication apparatus being operative to communicate with the optical transceivers on each of the multiplicity of doors via plural serial communications pathways, at least one of the plural pathways extending via optical transceivers mounted on a plurality of different doors.

9 Claims, 26 Drawing Sheets

FIG.9A
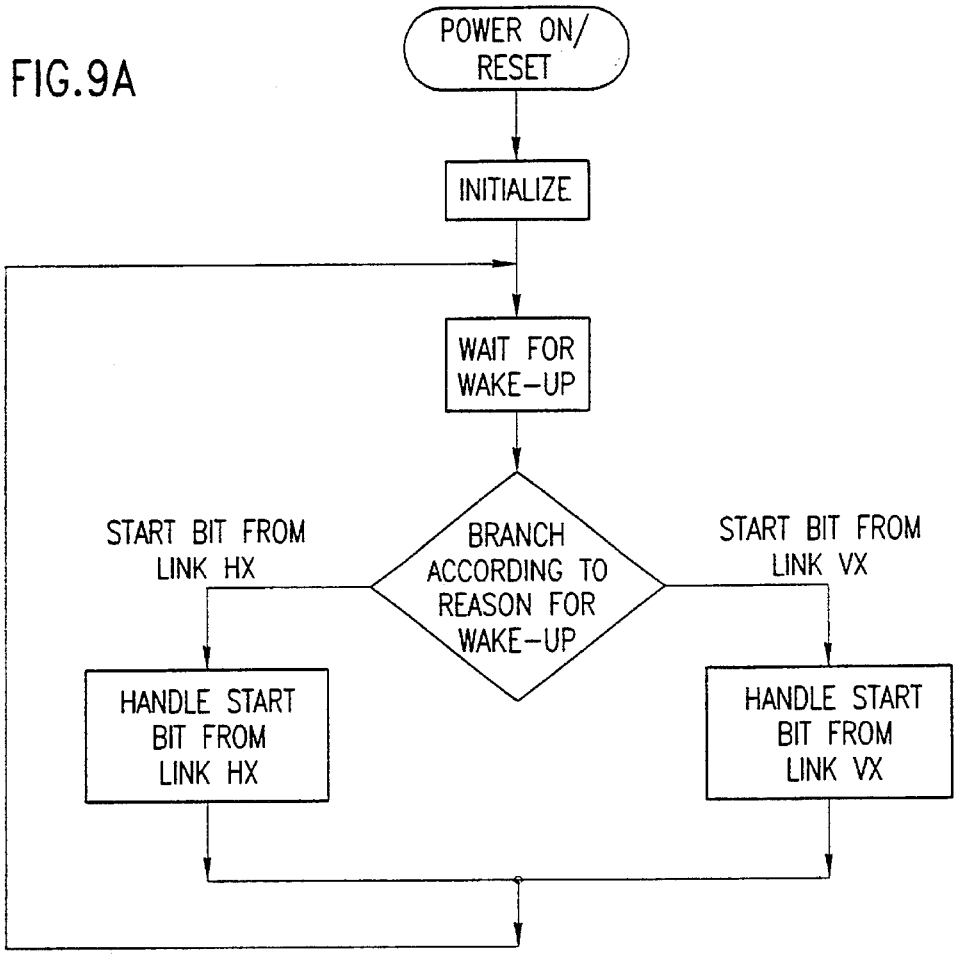
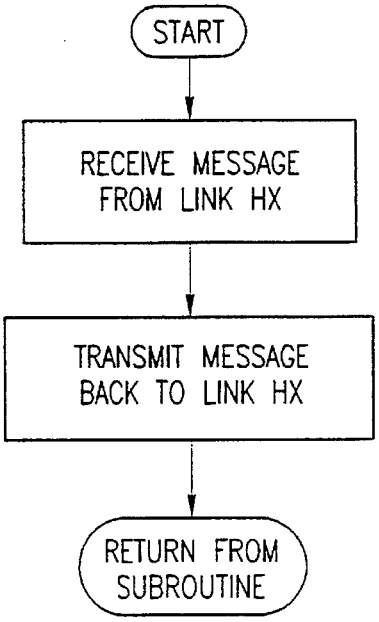
FIG.9B

SYSTEM FOR MONITORING A MULTIPLICITY OF DOORS USING MULTIPLE OPTICAL TRANSCEIVERS MOUNTED ON EACH DOOR

FIELD OF THE INVENTION

The present invention relates to monitoring apparatus generally and more particularly to electro-optical monitoring apparatus.

BACKGROUND OF THE INVENTION

There exist in the patent literature a variety of patents which deal with monitoring the opening and closing of a door. The following U.S. patents are representative of the prior art: 3,816,745; 3,875,403; 3,987,428; 4,266,124; 4,319,332; 4,324,977; 4,390,867; 4,583,082; 4,650,990; 4,742,337; 4,812,810; 4,841,283; 4,903,009; 4,965,551; 5,015,840; 5,063,288; 5,111,184; 5,134,386 and 5,138,299.

The most relevant prior art known to applicants is U.S. Pat. No. 5,219,386 to Kletzmaier et al which describes a locker unit comprising a plurality of lockers. Each locker is provided with a mechanical lock and an auxiliary lock having an electric drive. Unlike the present invention, Kletzmaier et al does not show or suggest communications apparatus for monitoring the open/closed status of the plurality of the lockers via plural alternative serial communications pathways.

SUMMARY OF THE INVENTION

The present invention seeks to provide an improved system for monitoring which is particularly useful for monitoring the opening and closing of a plurality of doors arranged in a generally planar array.

There is thus provided in accordance with a preferred embodiment of the present invention a system for monitoring a multiplicity of doors including at least one optical transceiver mounted on each of the multiplicity of doors and communications apparatus for communicating with each of the multiplicity of doors thereby to verify their position.

Preferably the communications apparatus is operative to communicate with at least some of the optical transceivers via others of the optical transceivers.

In accordance with a preferred embodiment of the present invention the communications apparatus is operative to communicate with the optical transceivers on the multiplicity of doors via a plurality of alternative communications pathways.

Preferably each transceiver includes, for at least some of the multiplicity of doors, a plurality of optical transmitters and receivers operative in a plurality of different directions. Each transceiver is preferably autonomously powered.

In accordance with a preferred embodiment of the present invention each transceiver includes at least one light emitting diode and light sensor. Preferably each transceiver includes a microprocessor.

Additionally in accordance with a preferred embodiment of the present invention, each transceiver is operative to provide an indication of an open door or inoperative transceiver downstream thereof in a communications chain.

Preferably, the communications apparatus includes a personal computer and communicates with the transceivers via at least two communications interfaces.

In accordance with a preferred embodiment of the present invention, the plurality of doors are doors of a bank of safe deposit boxes.

Additionally in accordance with a preferred embodiment of the present invention the system also includes apparatus for logging door openings and inoperative transceivers on a time based log.

BRIEF DESCRIPTION OF THE DRAWINGS

The present invention will be more fully understood and appreciated from the following detailed description, taken in conjunction with the drawings in which:

FIGS. 9A, 9B, 9C, 9D, 9E, 9F, 9G, 9H and 9I are flow charts illustrating the operation of the DCU circuitry of FIGS. 1–5.

LIST OF APPENDICES

Appendix A is a software listing in Intel Intellec-8 HEX dump format of software resident in the DCU, ECU and SCU circuitry;

Appendix B is a listing of a sequence of events which characterizes operation of an embodiment of the invention including four DCUs in four different operational cases.

DETAILED DESCRIPTION OF A PREFERRED EMBODIMENT

Figure 1:
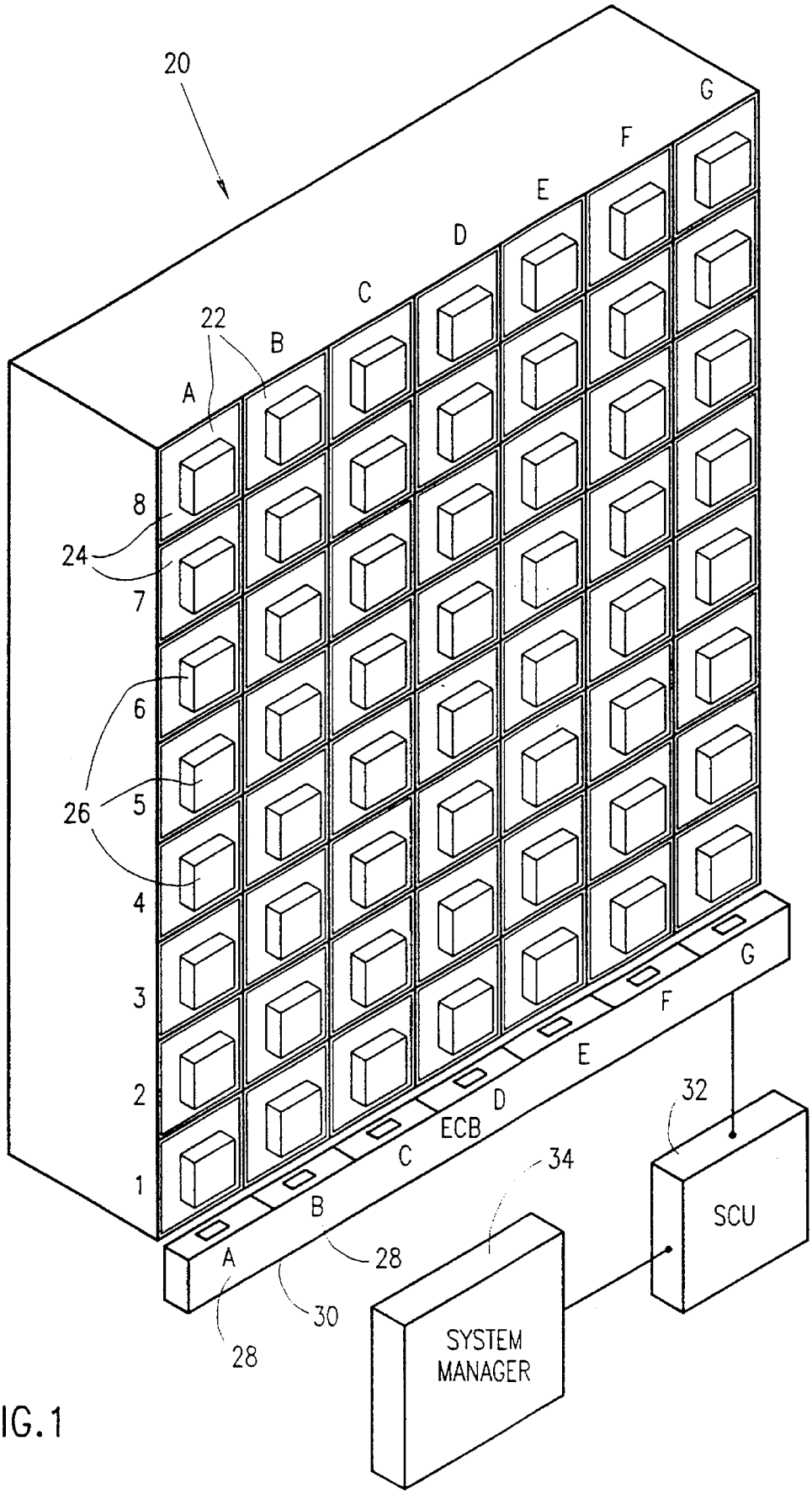
FIG. 1 is a pictorial illustration of a monitoring system constructed and operative in accordance with a preferred embodiment of the present invention.

Reference is now made to FIG. 1, which is a simplified pictorial illustration of a system for monitoring a plurality of doors, constructed and operative in accordance with a preferred embodiment of the present invention. The system is here shown in the context of monitoring a bank of safe deposit boxes, which is a preferred application. It is to be appreciated, however, that the invention is not limited to this or any other particular application.

For the purpose of explanation, the bank of safe deposit boxes, indicated generally by reference numeral 20, is arranged in a plurality of vertical columns 22, labeled A–G, and a plurality of horizontal rows 24, labeled 1–8. It is to be appreciated that any suitable number of boxes may be monitored in accordance with a preferred embodiment of the present invention.

In accordance with a preferred embodiment of the present invention, the system includes a multiplicity of door monitoring units 26, hereinafter termed "DCU"s, each of which is mounted on the door of a separate box. Communicating with the door monitoring units 26 are a plurality of edge monitoring units 28, hereinafter termed "ECU"s.

In the illustrated embodiment, a plurality of ECUs 28 are arranged along the bottom of the bank of boxes 20, one ECU being arranged in registration with one column of DCUs 26, such that, for example, the ECU labeled A communicates with the DCUs in column A and so on. Alternatively, the ECUs could be arranged along a vertical edge of the bank 20.

The ECUs are arranged for communication and are referred to collectively as a common block, hereinafter termed "ECB". A system control unit 32, hereinafter termed "SCU" controls the ECUs 30 and may in turn be controlled by a system manager 34, which may be embodied in software and be operated by an operator using a conventional personal computer.

Figure 2:
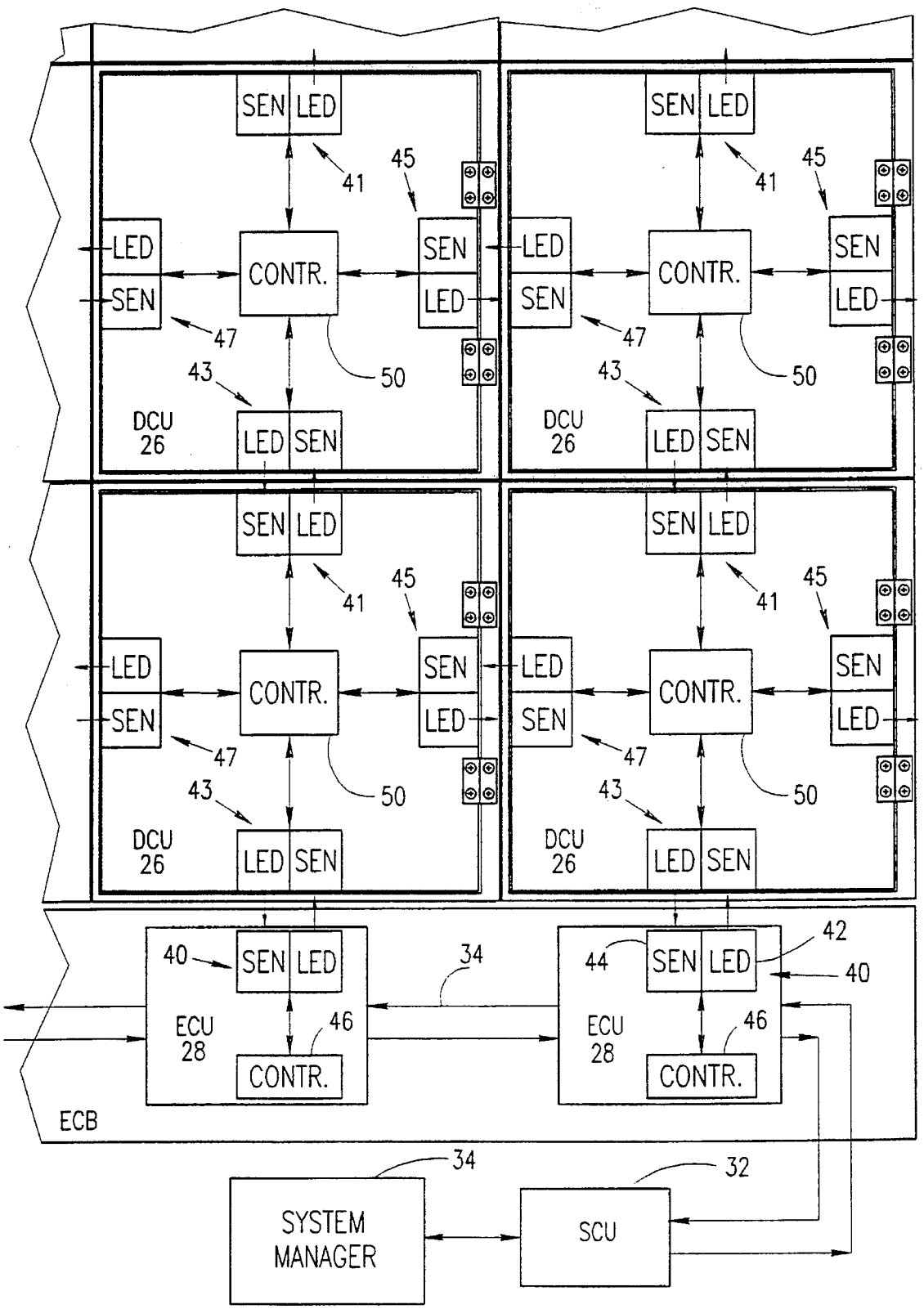
FIG. 2 is a simplified partially pictorial, partially block diagram illustration of part of the system of FIG. 1.

Reference is now made to FIG. 2, which illustrates a representative part of the system of FIG. 1. It is seen that each ECU 28 typically comprises an optical transceiver 40, preferably an LED 42 and a light sensor 44, such as a Schmitt photodetector. The optical transceiver pair 40 communicates with a controller 46, which in turn communicates along the ECB block 30 and with the SCU 32.

Each DCU preferably includes four optical transceivers 40, disposed along each edge thereof, communicating with a controller 50. The optical transceiver pairs 40 of each DCU 26 are arranged in opposite registration with adjacent corresponding optical transceiver pairs 40 on adjacent DCUs 26 and, where appropriate, with an optical transceiver pair 40 of an adjacent ECU 28, such that serial communication of all adjacent DCUs with each other and with adjacent ECUs 28 is provided, as will be described hereinafter in greater detail.

The four optical transceiver pairs 40 are designated as follows: Two vertically directed pairs, identified by reference numerals 41 and 43 respectively are termed UPPER LINK and LOWER LINK. Two horizontally directed pairs, identified by reference numerals 45 and 47 respectively are termed RIGHT LINK and LEFT LINK.

For the sake of convenience in notation, correspondingly positioned transceiver pairs on the ECUs and SCUs are also labeled in accordance with the above convention. In practice, for engineering and manufacturing simplicity, the ECUs, SCUs and DCUs may include the same hardware platform. In the ECUs, the RIGHT LINK and LEFT LINK of adjacent transceivers may communicate either by wire, as illustrated in FIG. 2, or optically.

Figure 3:
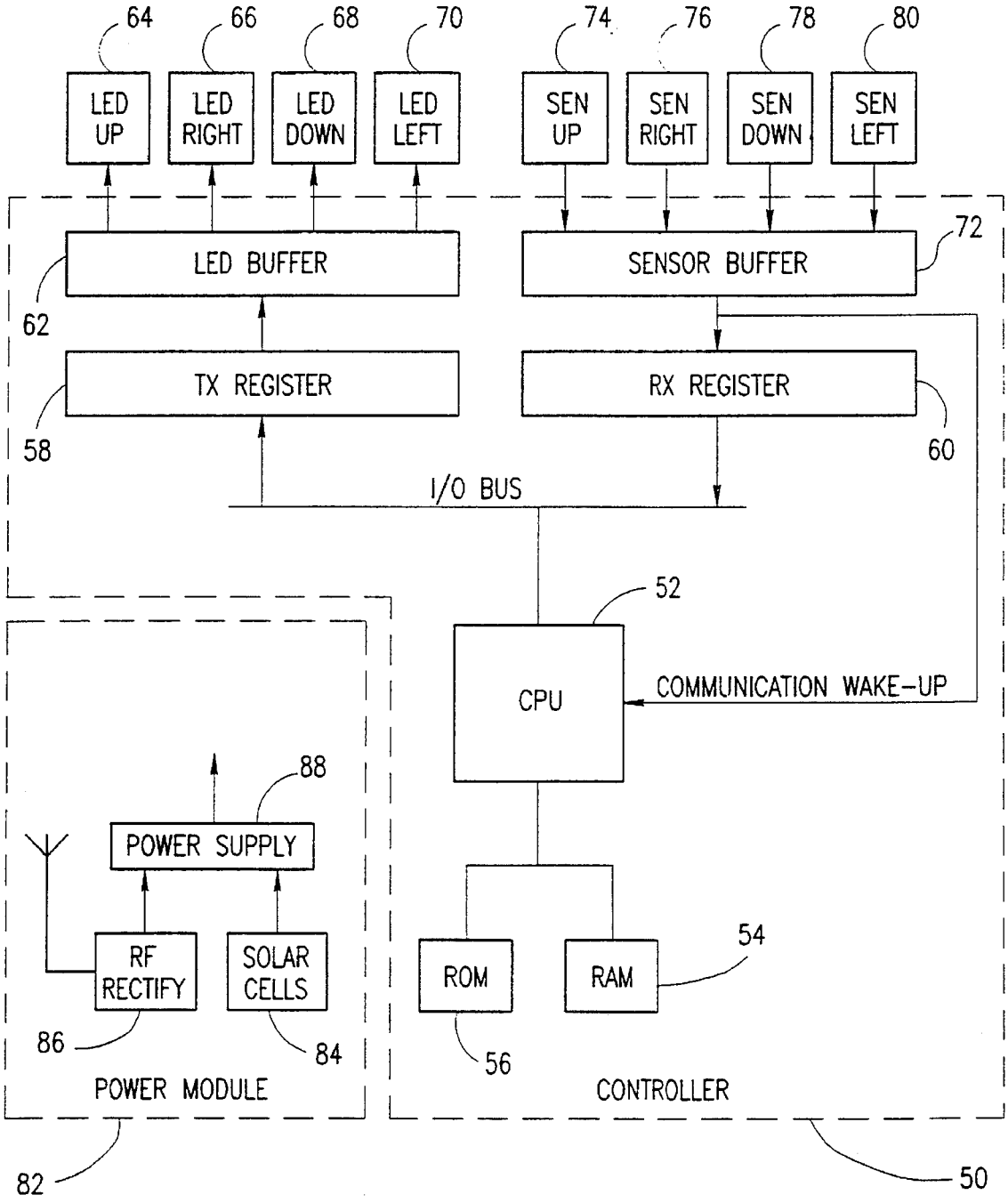
FIG. 3 is a simplified block diagram of DCU circuitry mounted on each door being monitored in the system.

Reference is now made to FIG. 3, which is a simplified block diagram illustration of the DCU 26. Controller 50 is delineated by dashed lines and includes a CPU 52 and an associated RAM 54 and ROM 56. The CPU 52 communicates via an I/O bus with respective transmit and receive registers 58 and 60. Register 58 communicates via a LED buffer 62 with four LEDS 64, 66, 68 and 70, each directed in a different direction. Register 60 communicates via a sensor buffer 72 with four sensors 74, 76, 78 and 80, each directed in a different direction.

A power module 82 provides power to the controller 50 and preferably includes an autonomous power source such as solar cells 84 or an RF energy receiver and rectifier assembly 86. The autonomous power source provides electrical power to a power supply 88, which converts the electrical power to voltages appropriate for use by the various elements of the DCU 26.

Figure 4:
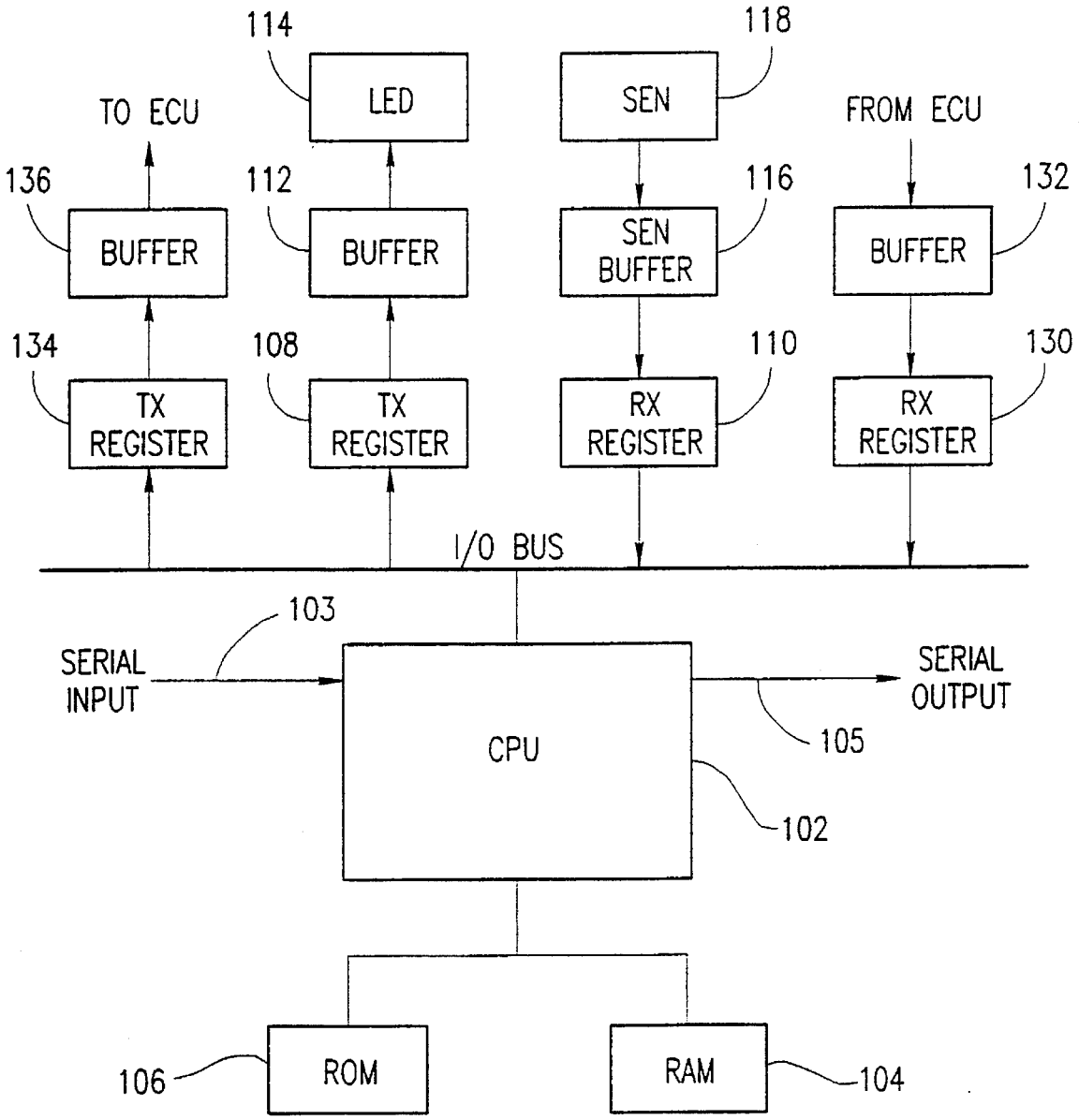
FIG. 4 is a simplified block diagram of ECU circuitry forming part of the apparatus of FIGS. 1 and 2.
Figure 5A:
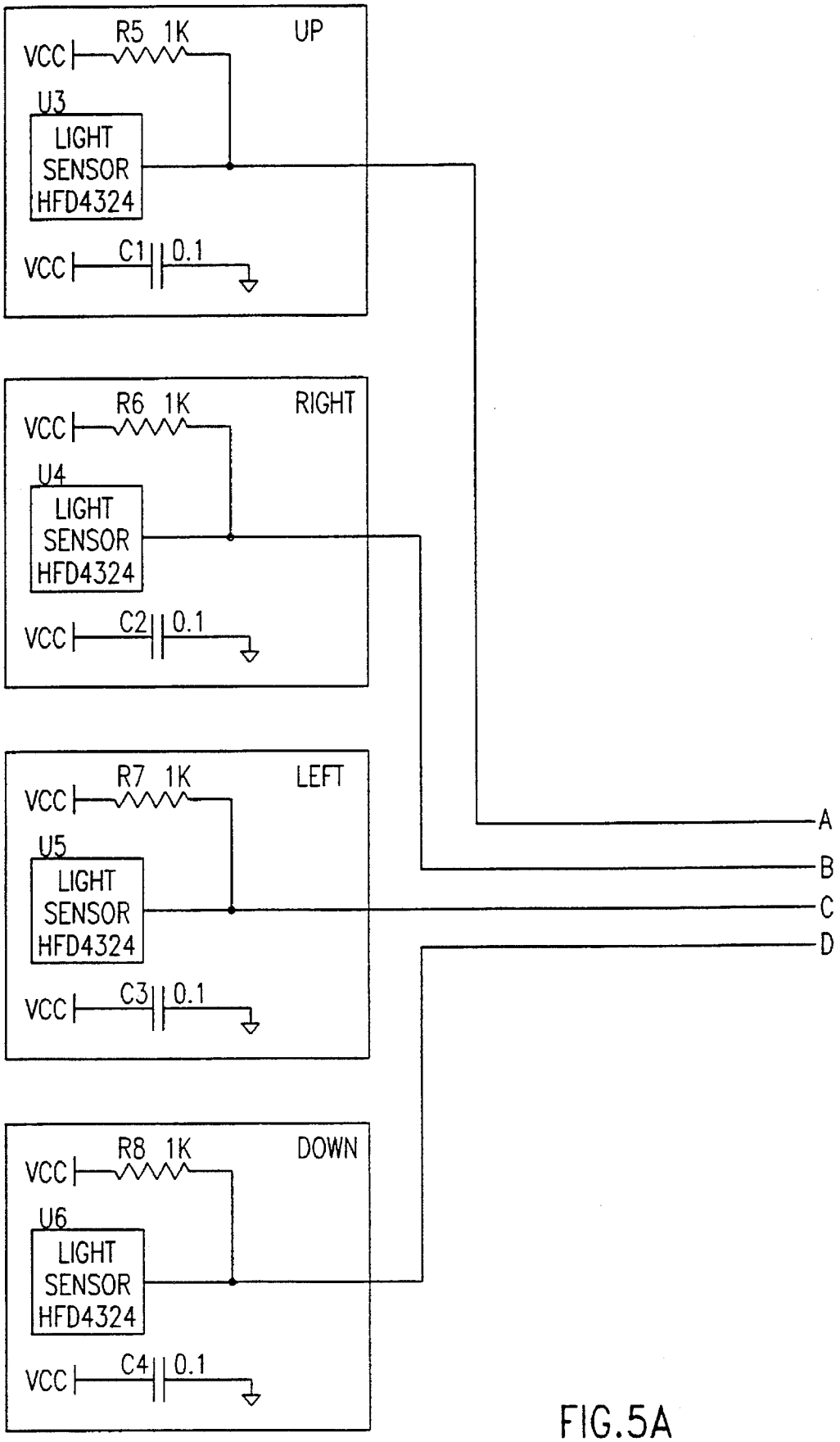
FIGS. 5A, 5B and 5C (hereinafter collectively referred to as FIG. 5) constitute an electrical schematic illustration of electrical circuitry employed in a preferred embodiment of the ECU, DCU and SCU circuitry.
Figure 5B:
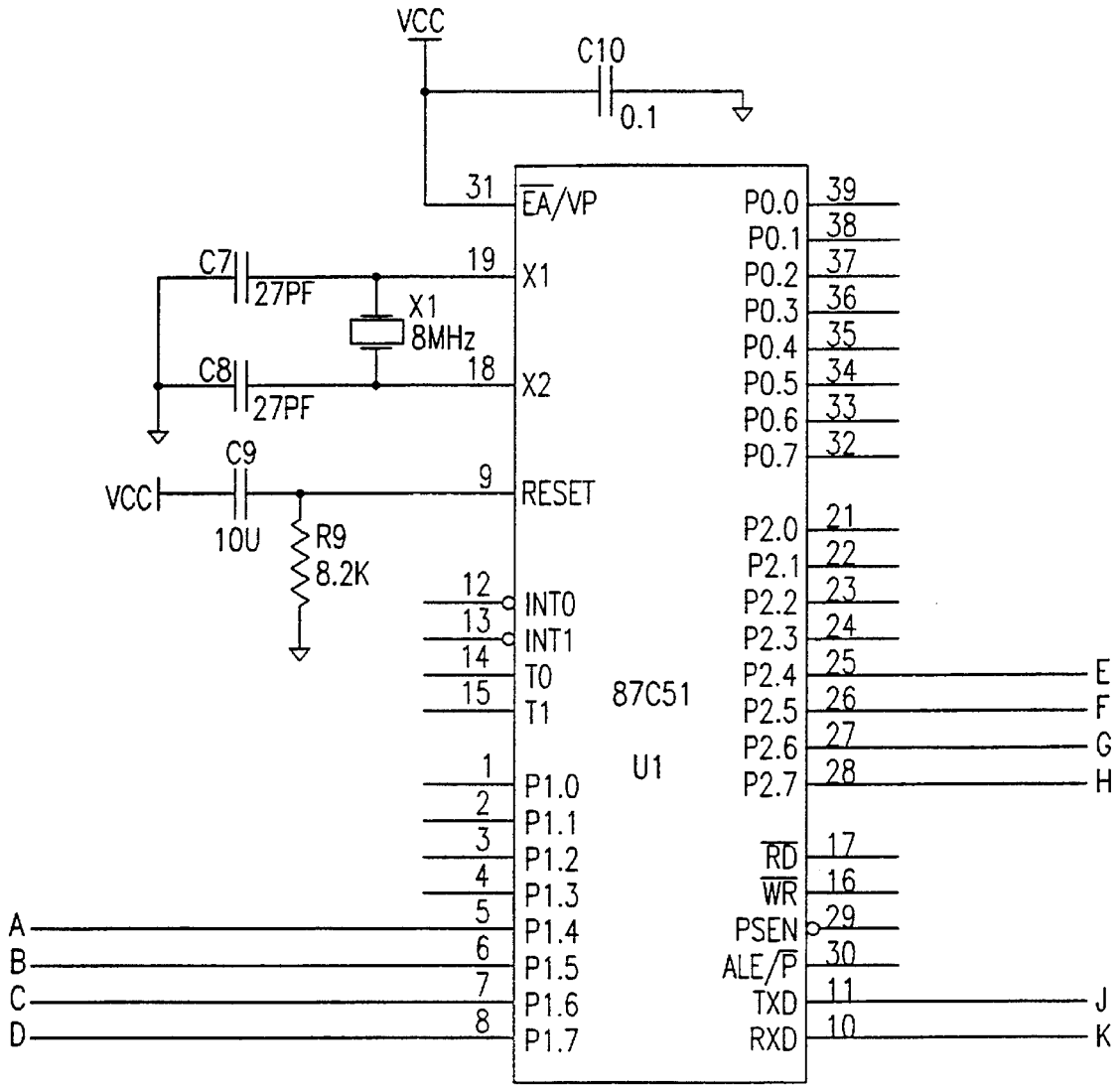
Figure 5B:
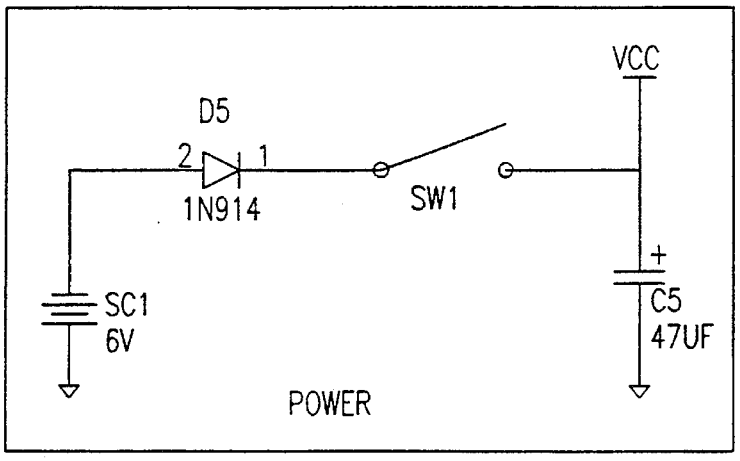
Figure 5C:
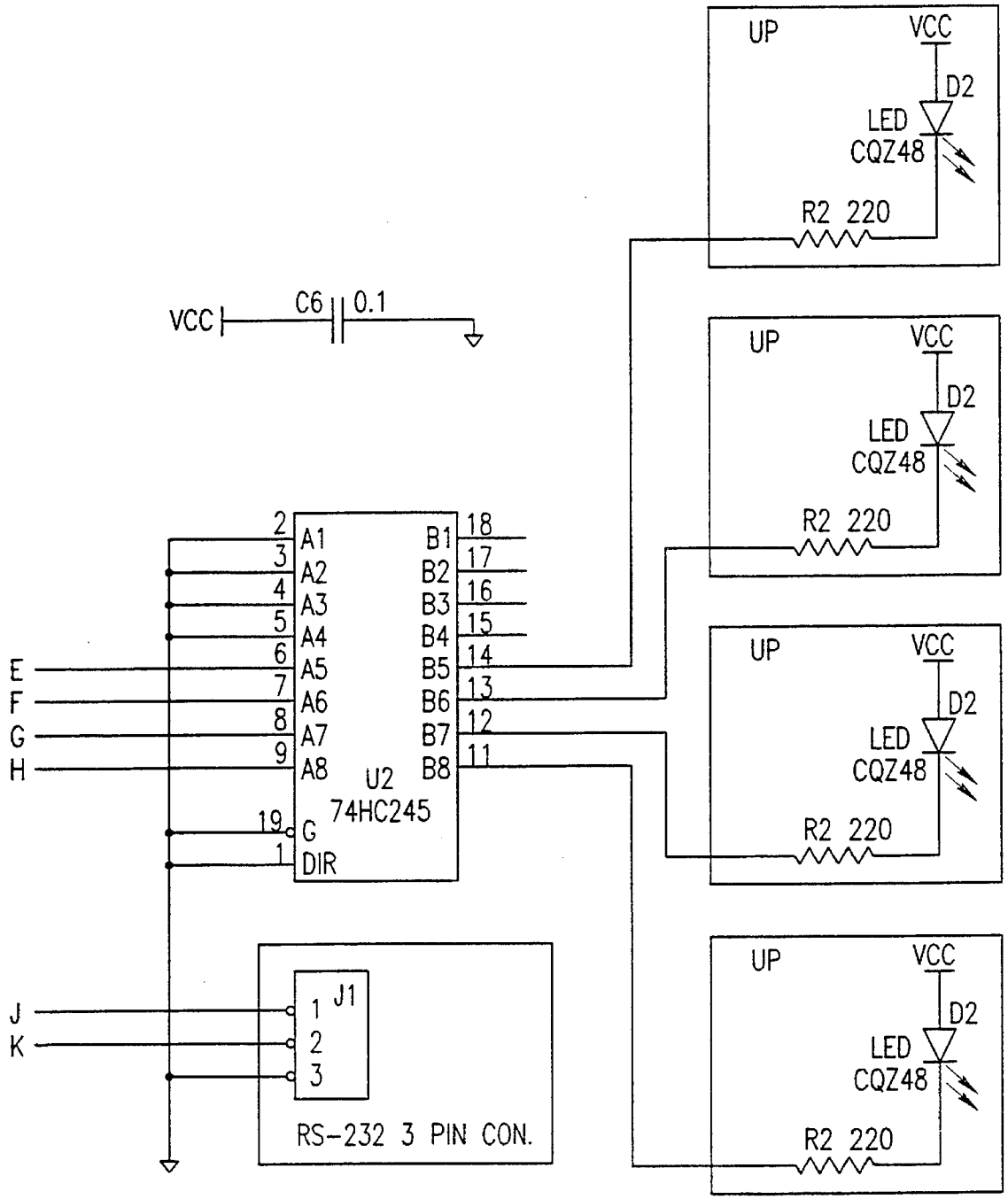

Reference is now made to FIG. 4, which is a simplified block diagram illustration of the ECU 28. Controller 46 includes a CPU 102 and an associated RAM 104 and ROM 106. The CPU 102 communicates via an I/O bus with respective transmit and receive registers 108, 134, 110 and 130. Register 108 communicates via a LED buffer 112 with an LED 114. Register 110 communicates via a sensor buffer 116 with a sensor 118.

Register 130 receives, via a buffer 132, information from an adjacent ECU, if present. Register 134 transmits via a buffer 136 to an adjacent ECU, if present.

The serial input 103 and serial output 105 from the CPU 102 provide communication with the SCU 32.

A schematic illustration of a preferred embodiment of DCU, circuitry appears in FIG. 5. The schematic illustration is believed to be self explanatory, accordingly, no additional description thereof is believed to be necessary. Identical circuitry is employed also for the ECU and SCU circuitry. A listing of software resident in the microcontroller of FIG. 5 appears in Appendix A, for DCU, ECU and SCU functionalities.

The operation of the apparatus of FIGS. 1–5 will now be explained with particular reference to FIGS. 6A–6I.

Figure 6A:
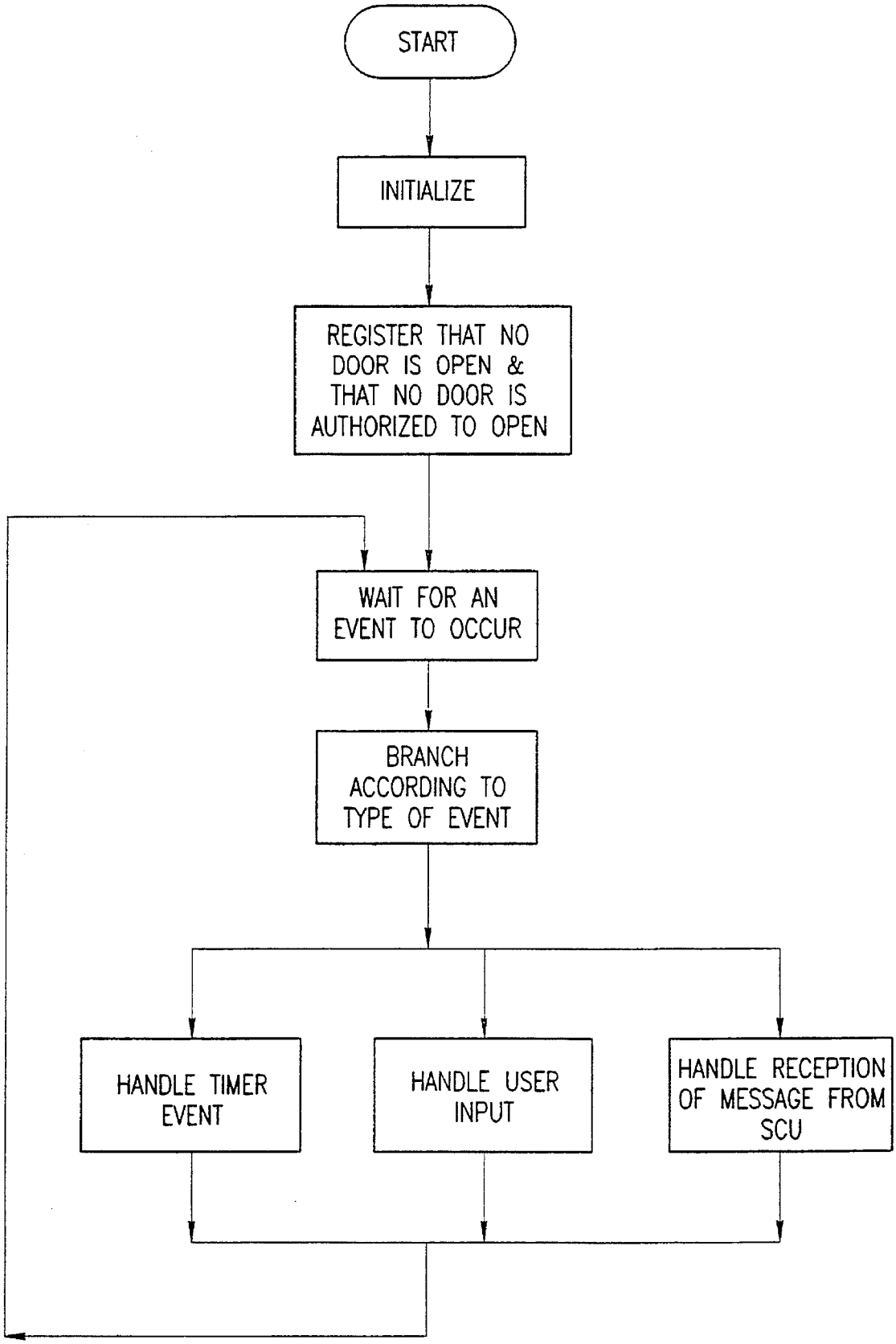
FIGS. 6A, 6B, 6C, 6D, 6E, 6F, 6G, 6H and 6I are flow charts illustrating the operation of the system manager of FIGS. 1 and 2.

As illustrated in FIG. 6A, in accordance with a preferred embodiment of the invention, the system manager is operative following initialization to confirm that no door is open and that no door has been authorized to be opened. The system manager is then prepared to deal with any one of three events: a timer event, a user input, receipt of a message from the SCU 32 (FIG. 1). Following occurrence of an event, the system manager returns to an idle state.

Figure 6B:
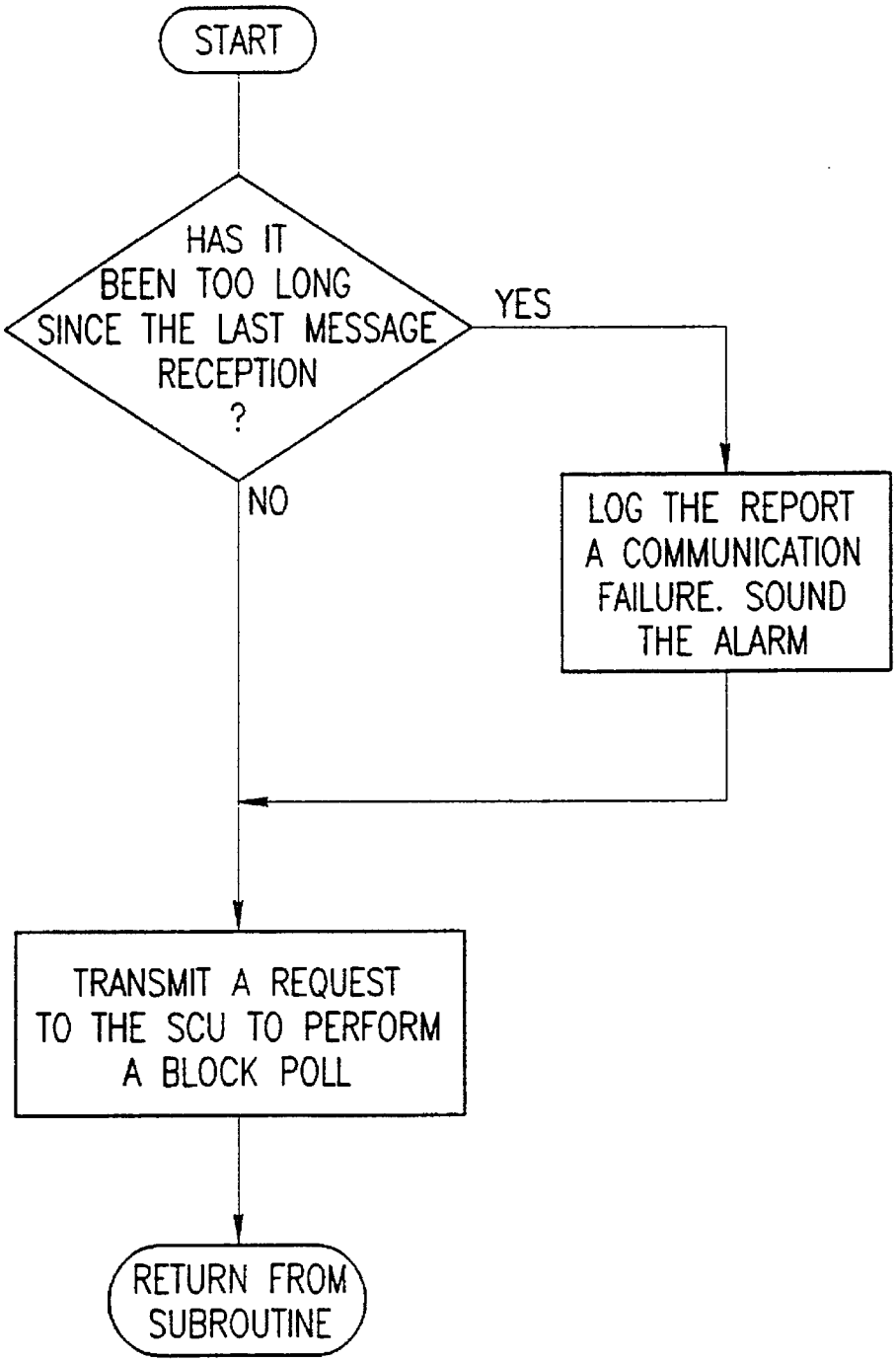

The operation of the system manager upon occurrence of a timer event is illustrated in FIG. 6B. If an excessive time has passed since the last message, a report to that effect is logged and an alarm is sounded. Otherwise, a request is transmitted to the SCU 32 to perform a block poll, as will be described hereinbelow.

Figure 6C:
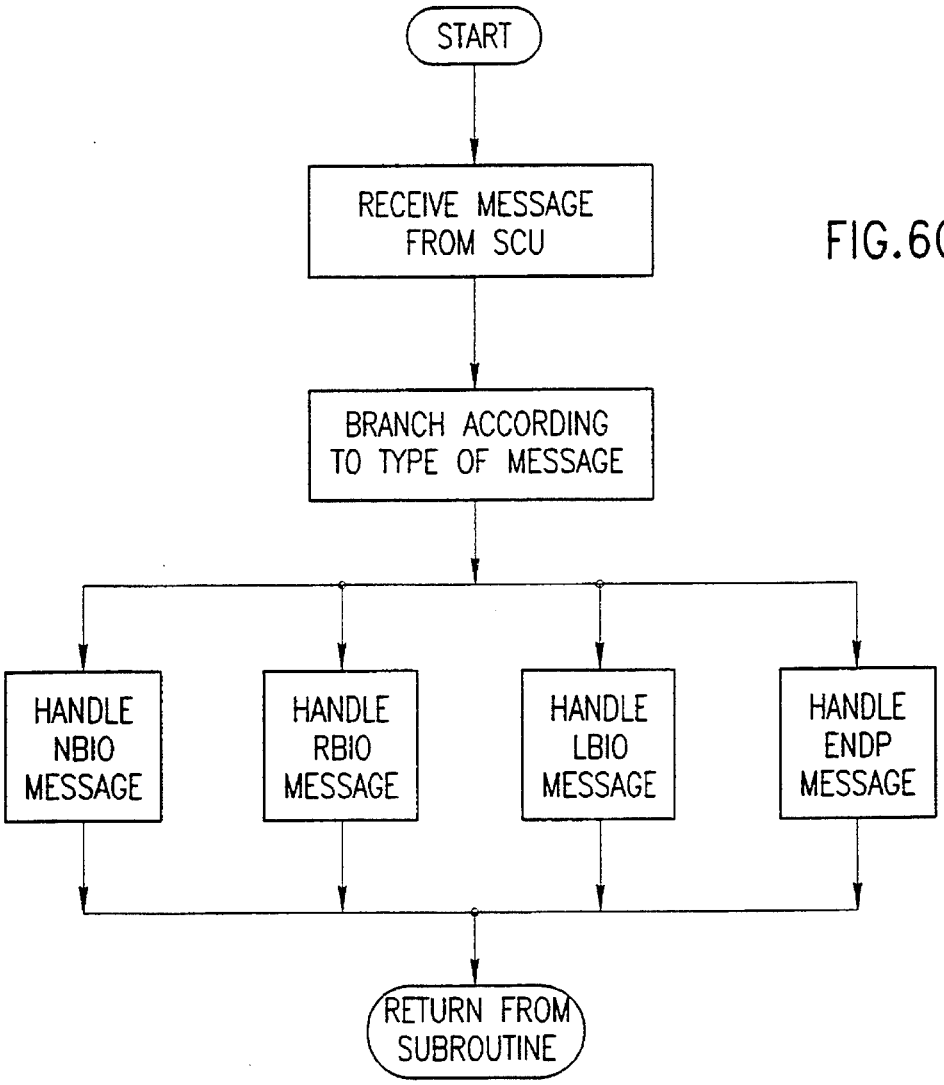
Figure 6D:
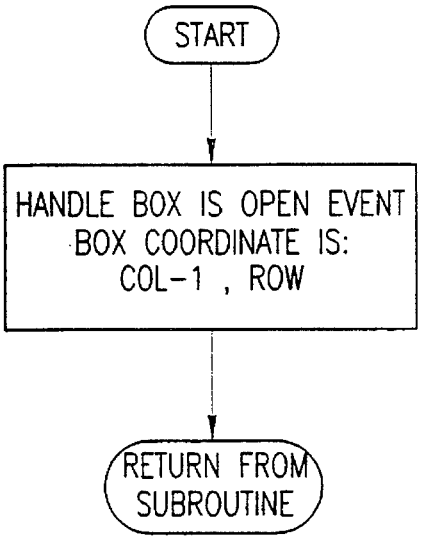
Figure 6E:
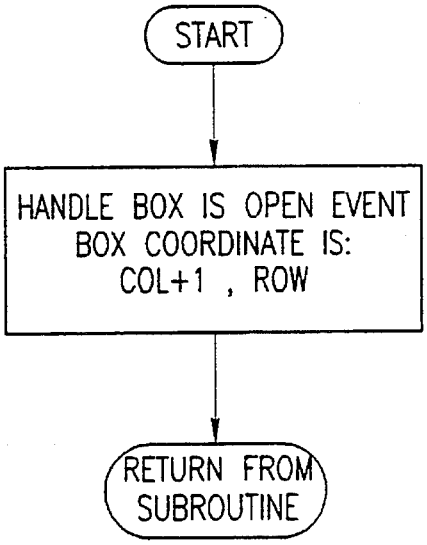
Figure 6F:
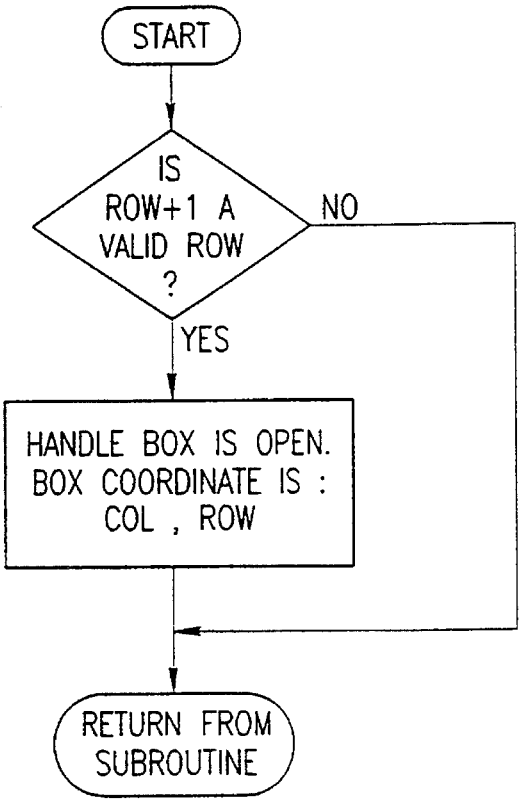
Figure 6G:
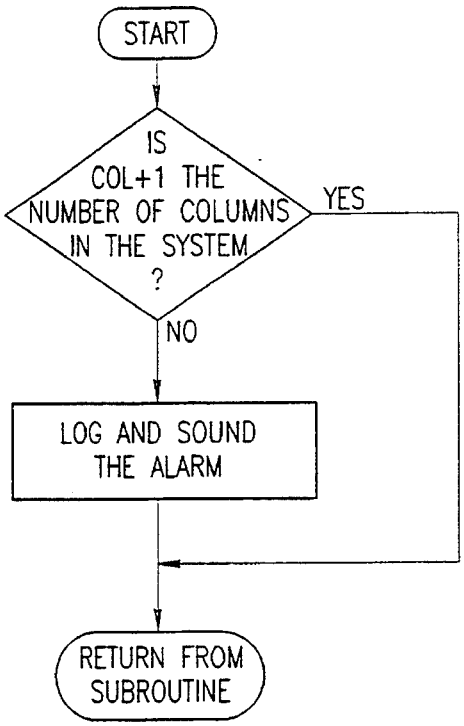

The operation of the system manager upon receipt of a message from the SCU is illustrated in FIG. 6C. Four types of messages are dealt with as will be described hereinbelow:

NBIO—NO BOX IS OPEN

RBIO—RIGHT BOX IS OPEN

LBIO—LEFT BOX IS OPEN

ENDP—END OF POLL

The subroutines dedicated to the above messages NBIO, LBIO, RBIO and ENDP are illustrated in respective FIGS. 6F, 6D, 6E and 6G. Each of the subroutines shown in FIGS. 6F, 6D and 6E employ a subroutine which is explained hereinbelow with reference to FIG. 6I. Other than this subroutine, the subject matter of FIGS. 6F, 6D, 6E and 6G is not believed to require further explanation.

Figure 6H:
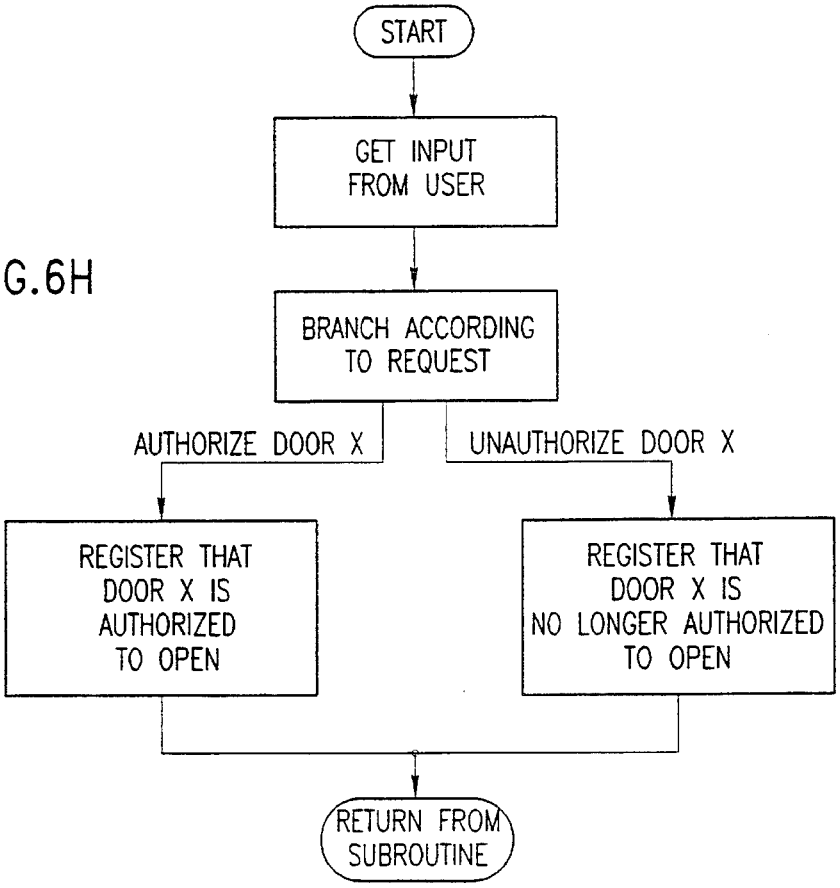

The operation of the system manager upon receipt of an input from a user is illustrated in FIG. 6H. A user indicates a single door which he is authorized to open and normally provides the requisite identification to a security operative. The system manager notes in a register that the indicated door is authorized to be opened. When the user has completed accessing a given vault via the door, the system manager notes in a register that the indicated door is no longer authorized to open. The system as described herein is configured to only permit one authorized box opening at any given time. Alternatively, the system could be configured to permit more than one authorized box opening at a given time.

Figure 6I:
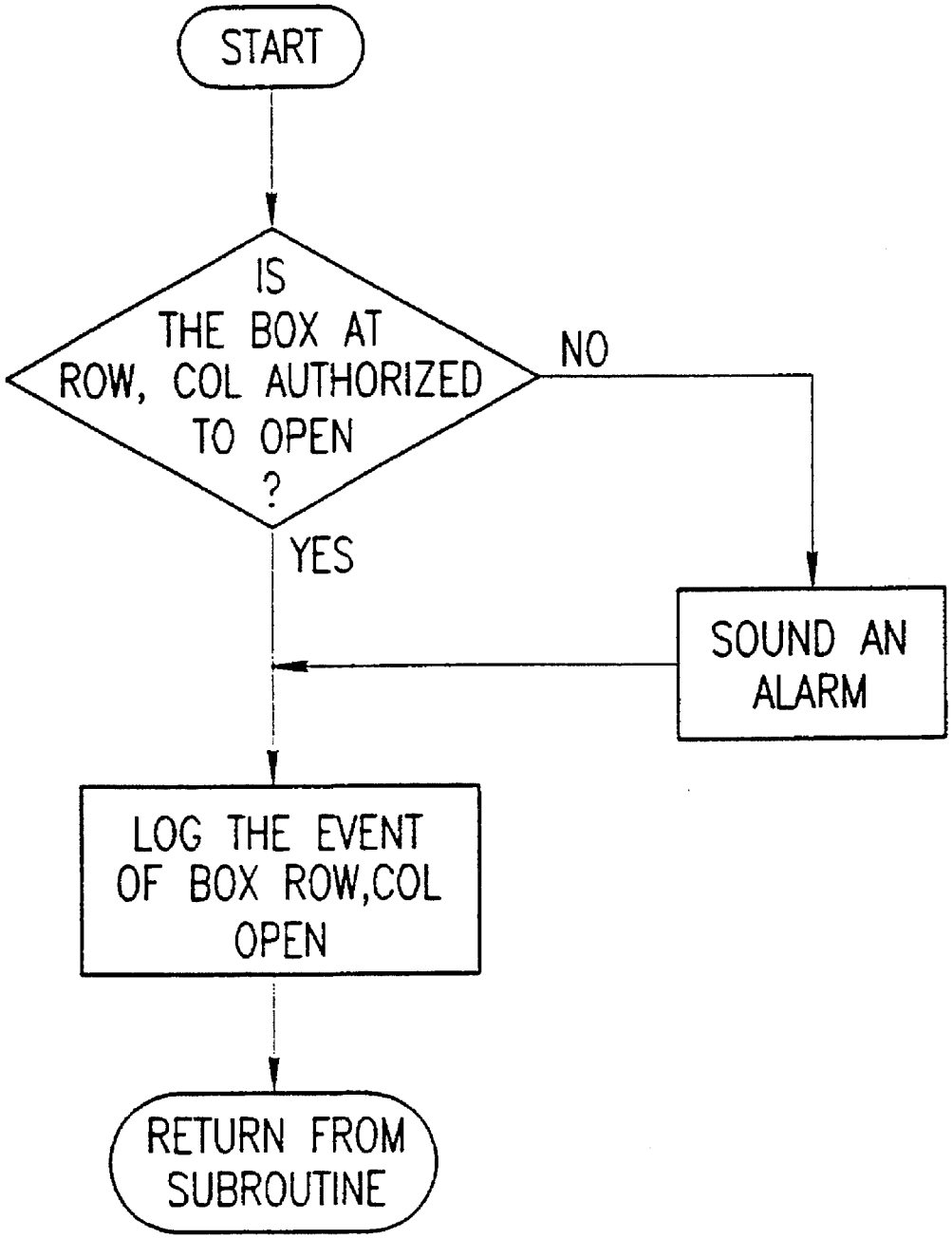

The operation of the system manager upon reception of a message from a SCU, indicating the open status of a door is illustrated in FIG. 6I. The system checks to determine whether the door which is indicated to be open is authorized to be open. If not, an alarm is sounded. In any event, the open status of the door is logged by column and row numbers.

Figure 7A:
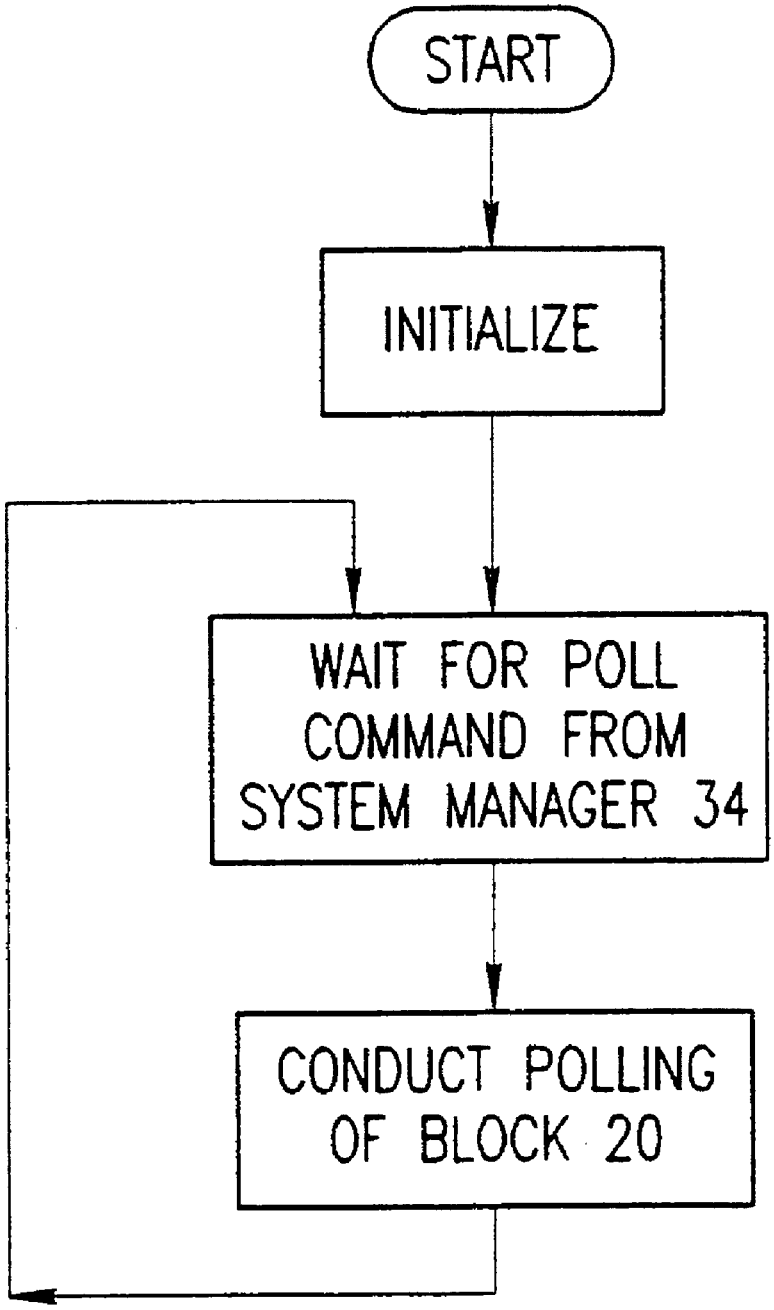
FIGS. 7A and 7B are flow charts illustrating the operation of the SCU circuitry of FIGS. 1–5.
Figure 7B:
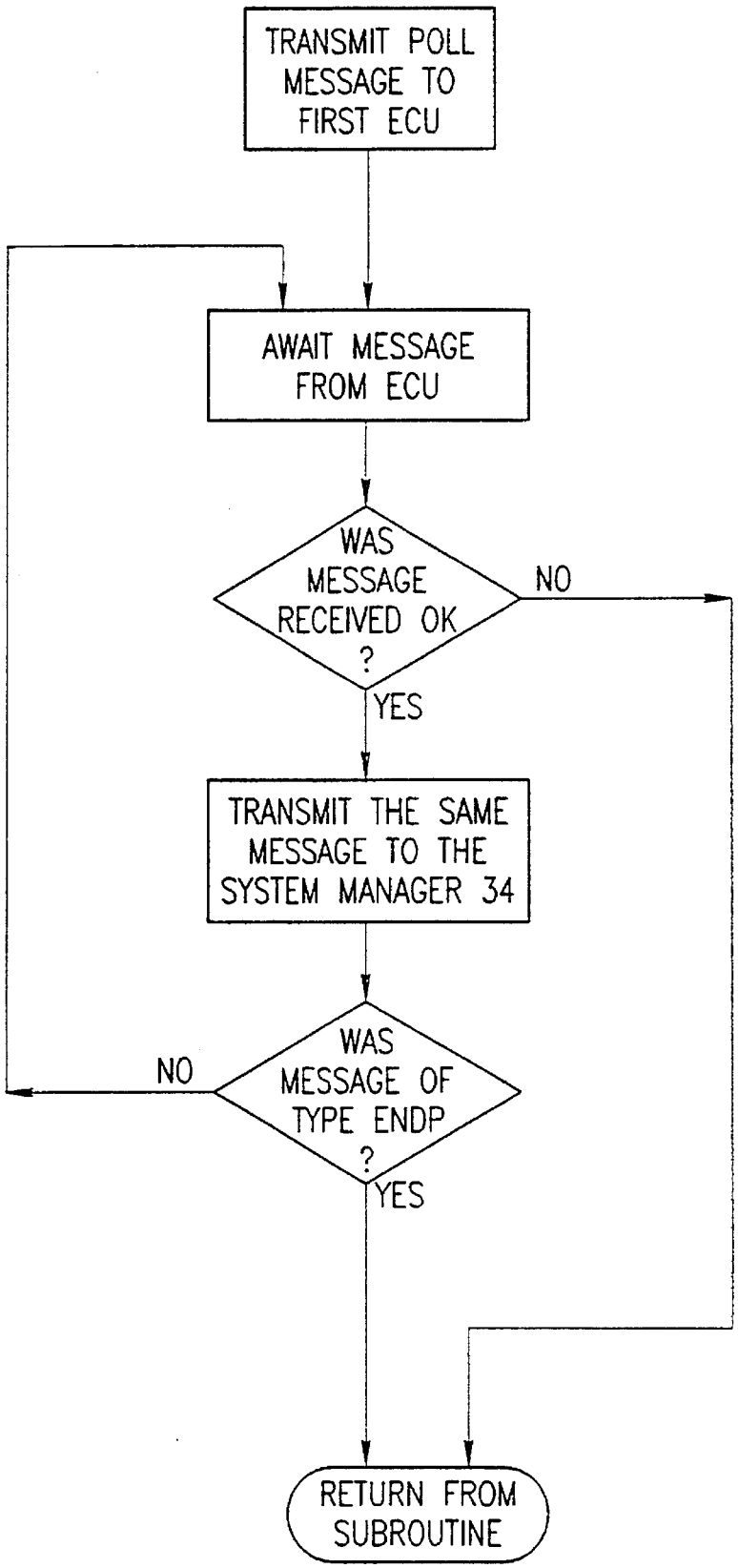

Reference is now made to FIGS. 7A and 7B which illustrate the operation of SCU circuitry 32. Following initialization, the SCU circuitry awaits a poll command from the system manager 34. Upon receipt of the poll command it conducts polling the status of block 20 (FIG. 1).

Generally speaking, the task of the SCU is to transmit a poll instruction message to a first ECU in response to a poll system instruction from the system manager 34 (FIG. 1) and to then receive the various return messages therefrom. These messages are then retransmitted by the SCU to the system manager 34.

As illustrated in FIG. 7B, the polling of block 20 is achieved by transmitting a poll message to a first ECU and then awaiting a message from the ECU. If the message is properly received, it is echoed to the system manager 34. If the message is not properly received, the SCU exits the subroutine of FIG. 7B. The subroutine is operative until an ENDP message is received and echoed to the system manager 34.

Reference is now made to FIGS. 8A, 8B, 8C, 8D, 8E and 8F illustrating the operation of the system manager of FIGS. 1–5.

The following notation will be employed in the discussion which follows:

LINK HX—one of the two horizontal links on a transceiver (DCU, ECU or SCU).

LINK 1-HX—the other one of the two horizontal links on the transceiver (DCU, ECU or SCU).

LINK VX—one of the two vertical links on a transceiver (DCU, ECU or SCU).

LINK 1-VX—the other one of the two vertical links on the transceiver (DCU, ECU or SCU).

Figure 8A:
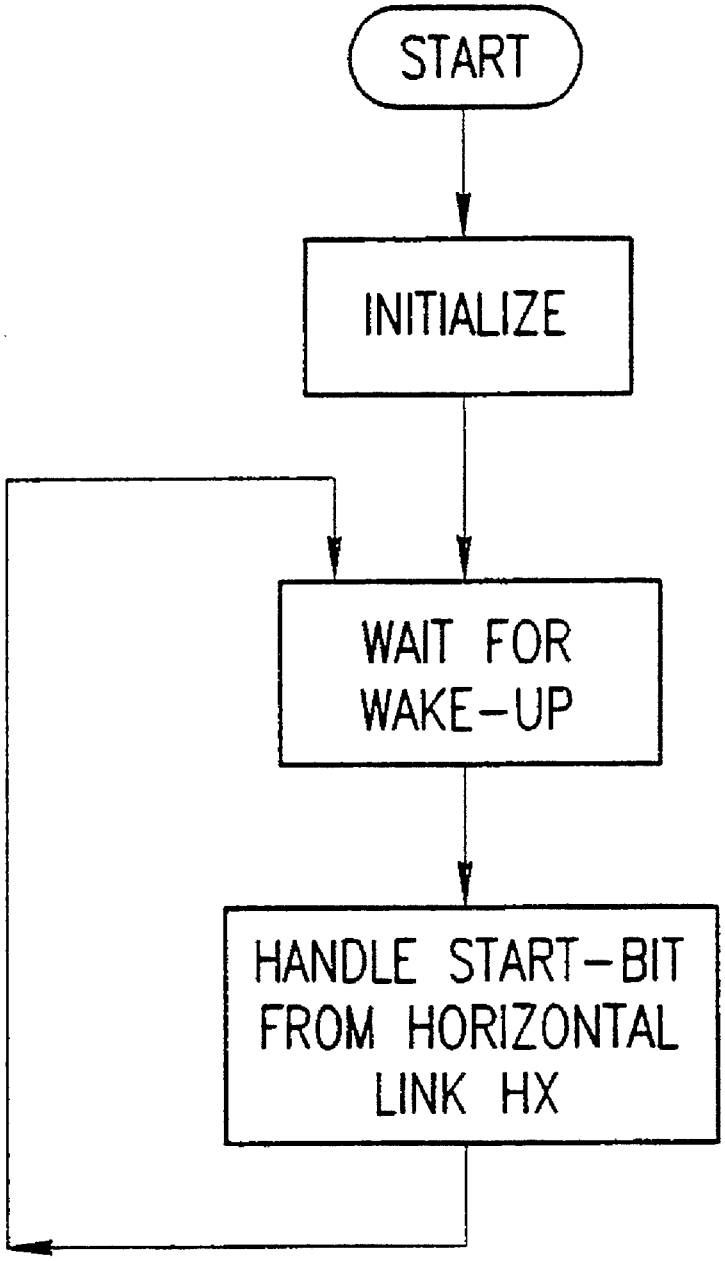
FIGS. 8A, 8B, 8C, 8D, 8E and 8F are flow charts illustrating the operation of the ECU circuitry of FIGS. 1–5.

As seen in FIG. 8A, following initialization, the ECU waits for a wake-up signal and upon receipt thereof handles a start-bit from a LINK HX.

Figure 8B:
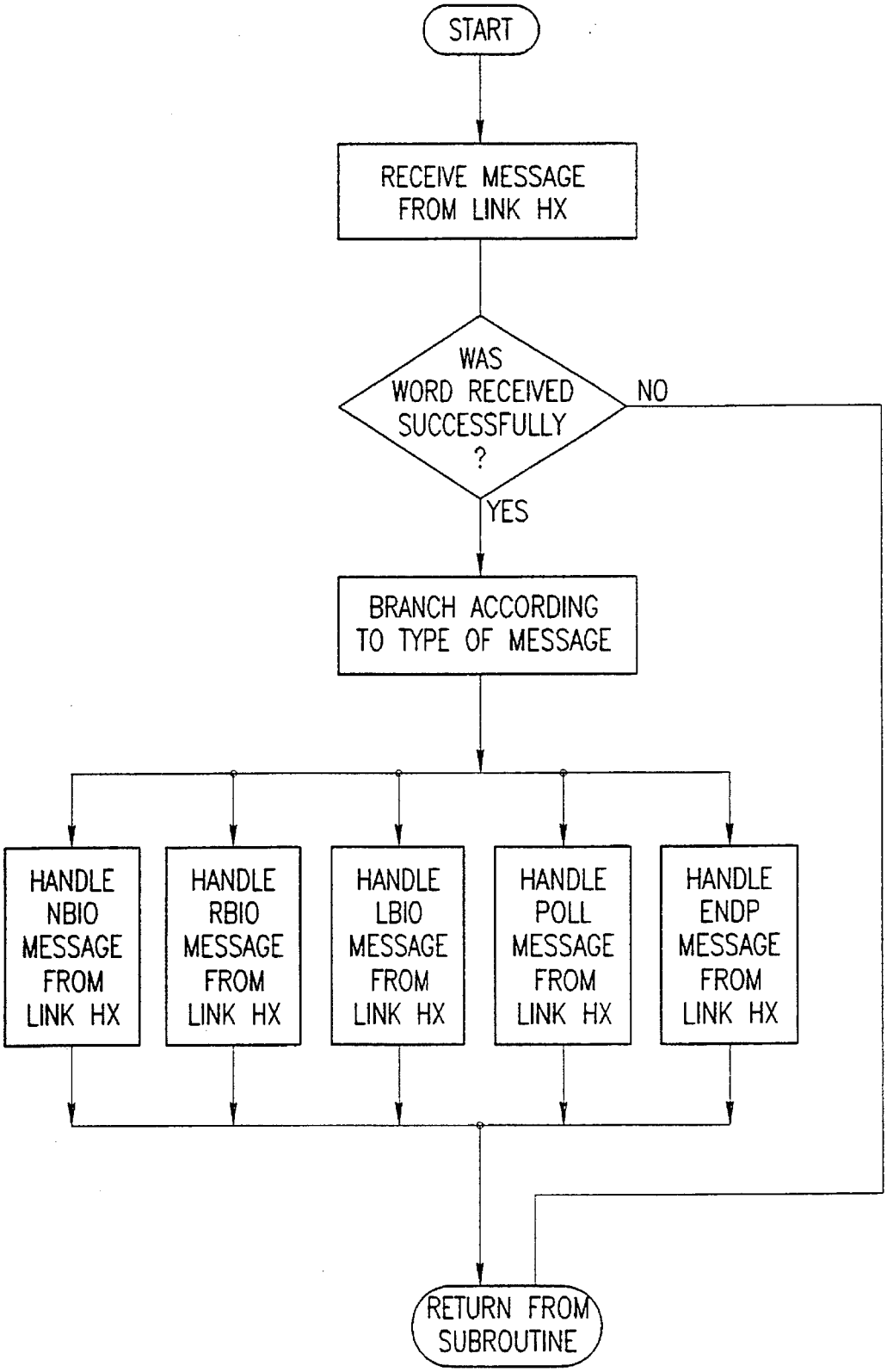

As illustrated in FIG. 8B, upon receipt of the message along LINK HX, and if the message is successfully received, the ECU circuitry deals with the following types of messages received from LINK HX:

NBIO—NO BOX IS OPEN
RBIO—RIGHT BOX IS OPEN
LBIO—LEFT BOX IS OPEN
ENDP—END OF POLL
POLL—POLL INSTRUCTION

Figure 8C:
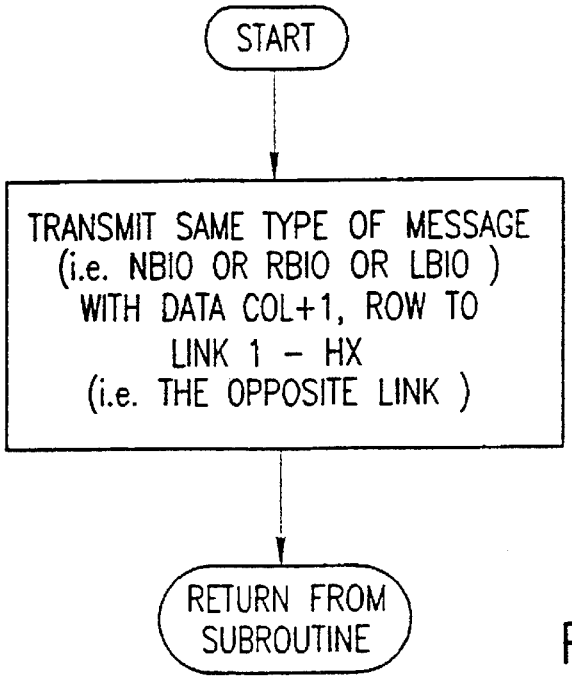

As illustrated in FIG. 8C, upon receipt of an NBIO, RBIO or LBIO message, the ECU retransmits the same message with the received column and row indices (COL, ROW) changed to (COL+1,ROW) to LINK 1-HX, i.e. the opposite link on the same transceiver.

Figure 8D:
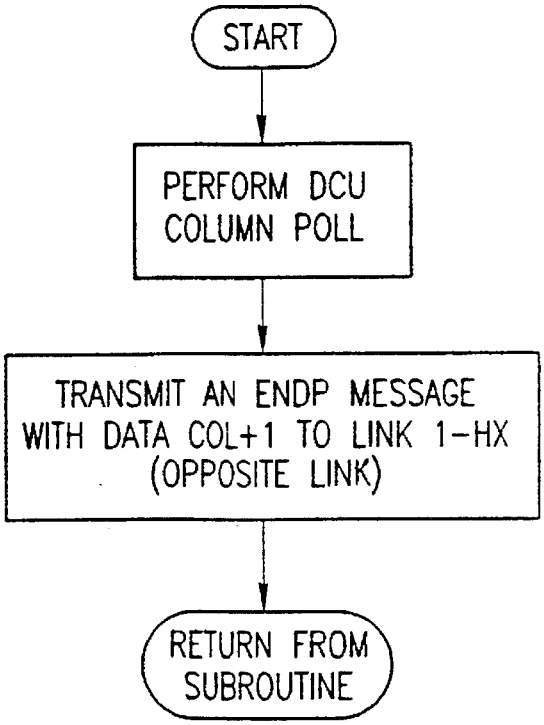

As illustrated in FIG. 8D, upon receipt of an ENDP message from LINK HX, the ECU performs a DCU column poll and transmits an ENDP message with the received (COL, ROW) indication changed to (COL+1,ROW) to link 1-HX, i.e. the opposite link.

Figure 8E:
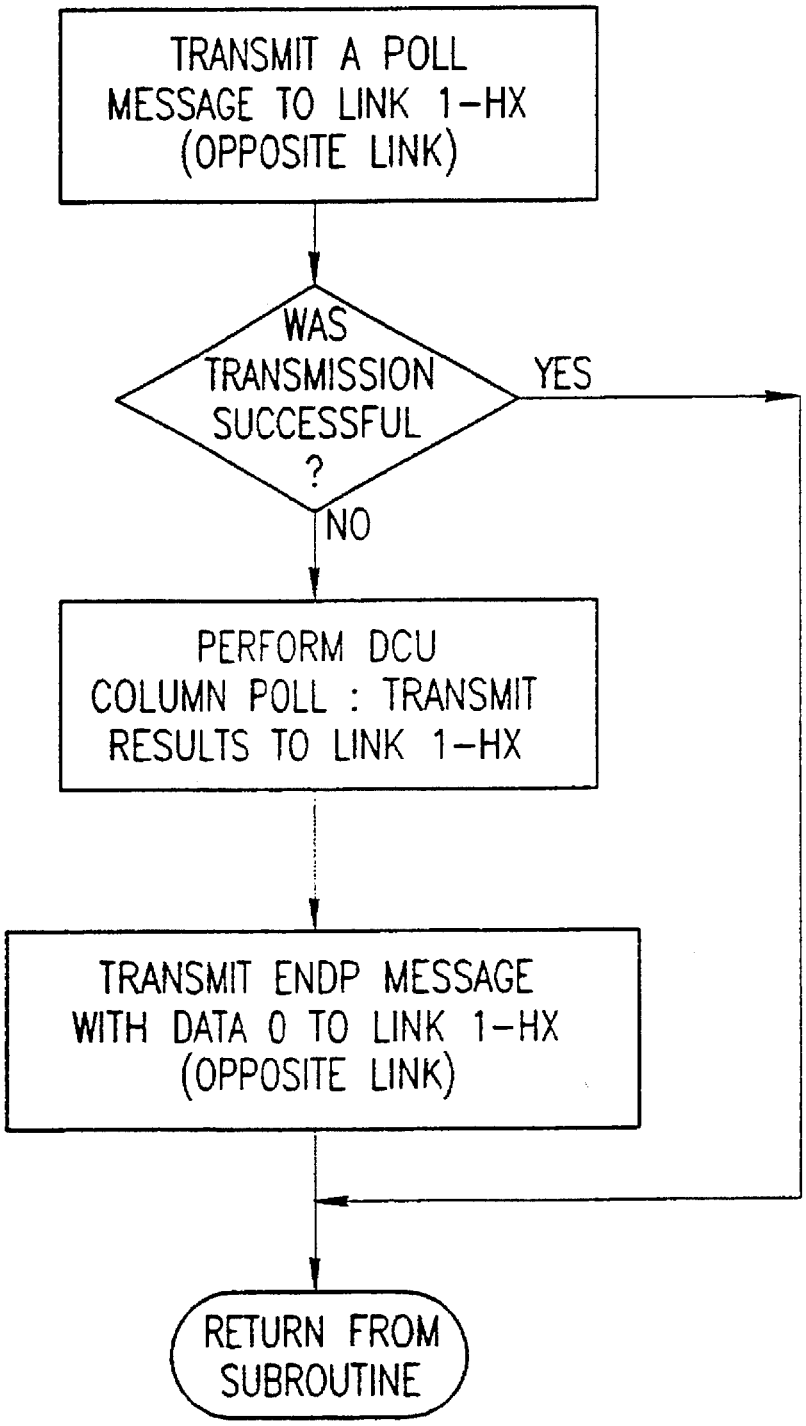

As illustrated in FIG. 8E, upon receipt of a POLL message from LINK HX, the ECU also transmits a poll message to LINK 1-HX. If the transmission is not successful it performs a DCU column poll and transmits the result to link 1-HX. It also transmits a ENDP message with a column indication 0 to link 1-HX.

Figure 8F:
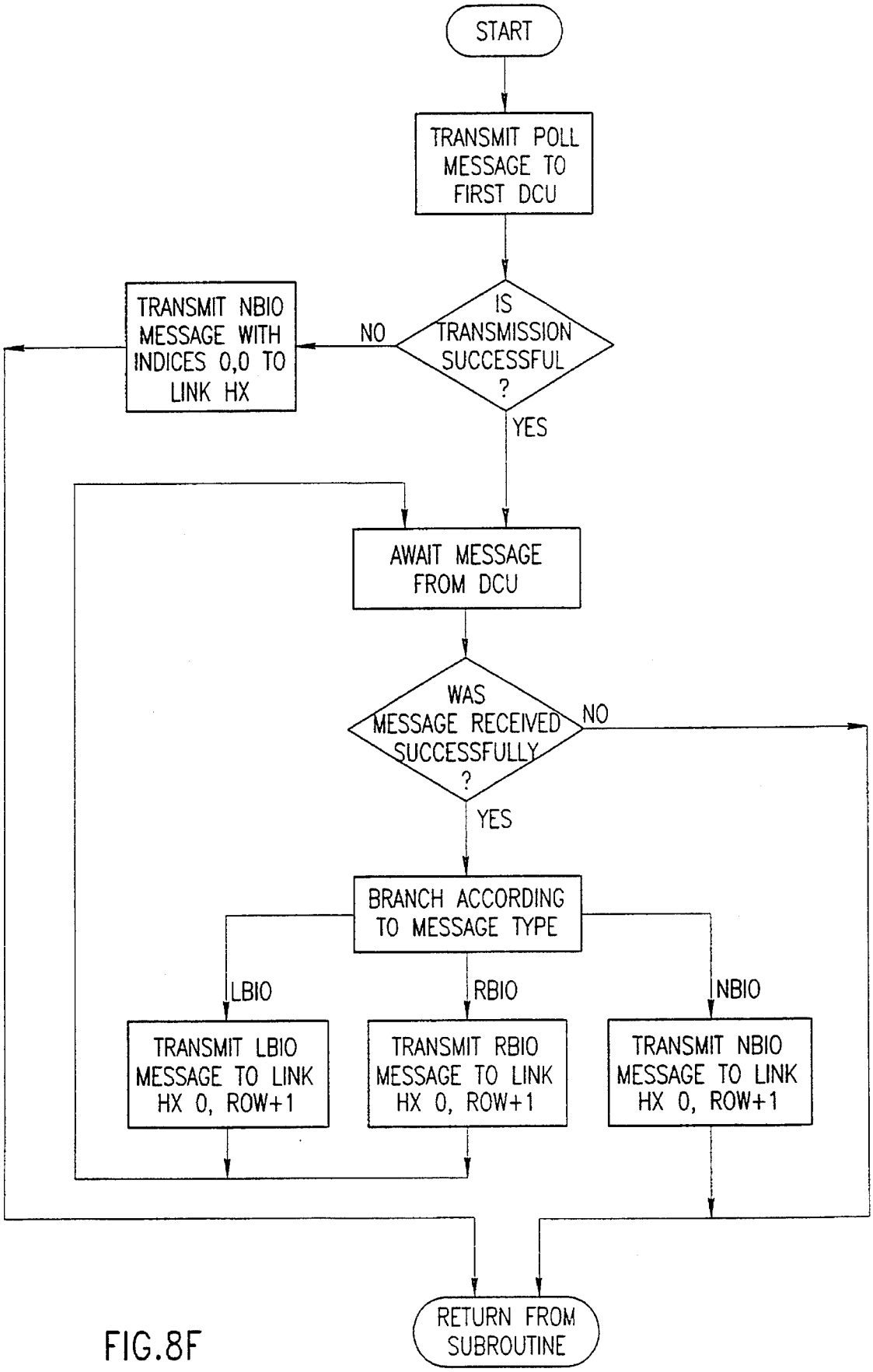

As seen in FIG. 8F, the ECU transmits a POLL message to the most adjacent DCU (transceiver). If the transmission is not successful, the ECU transmits an NBIO message with indices (0,0) to LINK HX for ultimate transmittal to the SCU 32 and the system manager 34.

If the transmission is successful, the ECU awaits a message from the adjacent DCU. If such a message is not received successfully, the ECU exits the subroutine. If a message is successfully received from the adjacent DCU, it is dealt with depending on the type of message, i.e. LBIO, RBIO or NBIO.

In the event of receipt of any of the above three types of messages the ECU transmits a message of the same type to a link HX for ultimate transmittal to the SCU 32 and the system manager 34. The index of the message is a column index 0 and a row index equal to the received index incremented by +1.

In the event of receipt of RBIO and LBIO messages, the ECU remains in the subroutine awaiting further messages. If an NBIO message is received, the ECU exits the subroutine.

Reference is now made to FIGS. 9A, 9B, 9C, 9D, 9E, 9F, 9G, 9H, 9I and 9J which are flow charts illustrating the operation of the DCU circuitry of FIGS. 1–5.

As illustrated in FIG. 9A, upon supply of power to the DCU circuitry and initialization thereof, the DCU remains in a dormant state until it is awakened up by a received signal. The received signal may come from a source which is vertically separated from the DCU or a source which is horizontally separated from the DCU. Once the received signal has been dealt with, the DCU returns to its dormant state.

Figure 9C:
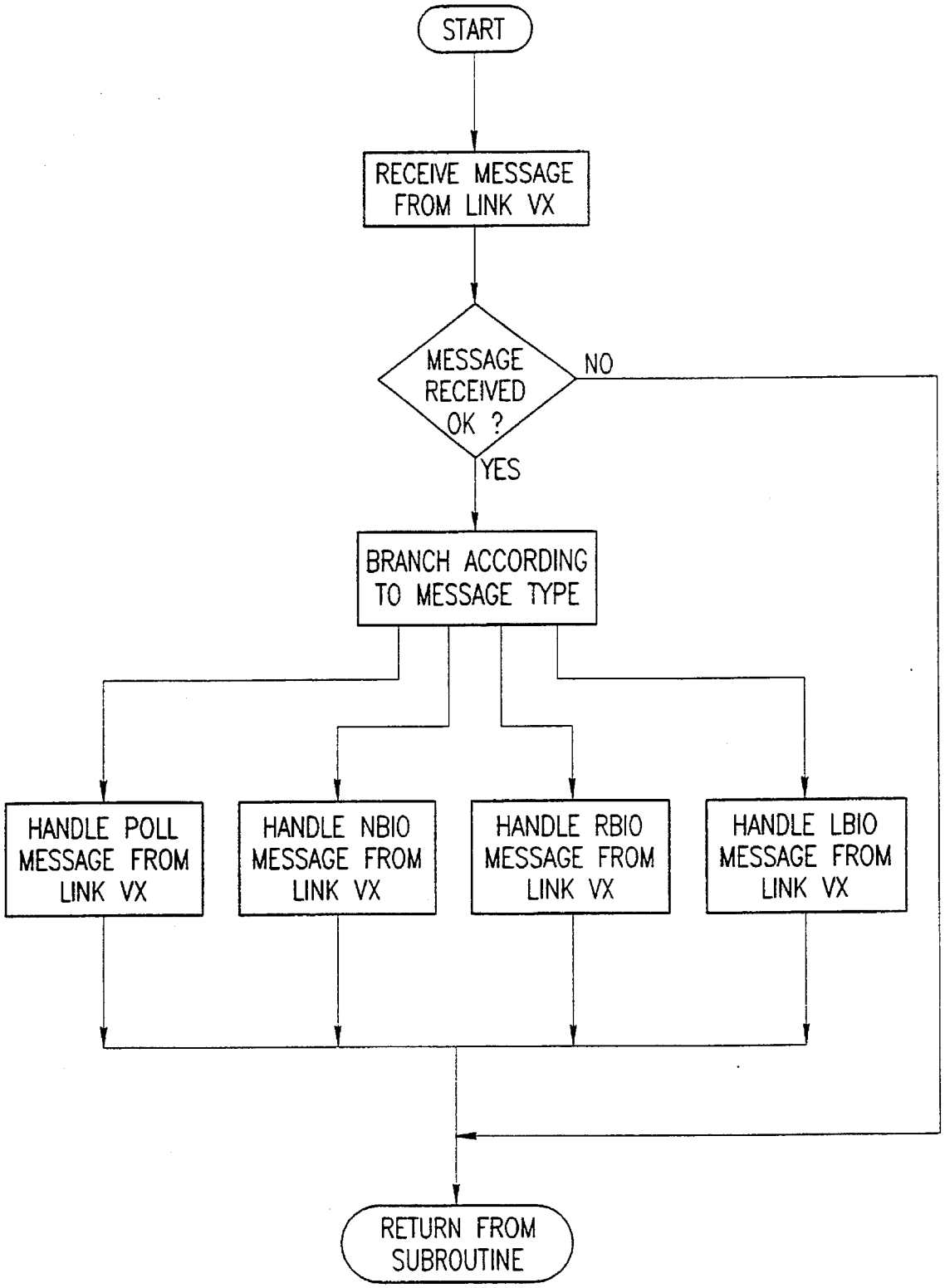

As seen in FIG. 9B, if the signal is received from a source that is horizontally separated from the DCU, the DCU retransmits the communication back to the source. If, however, as seen in FIG. 9C, the signal is received from a source that is vertically separated from the DCU, the DCU checks if the message has been correctly received. If so, each message is handled separately and when it has been handled, the DCU returns to its dormant state.

Figure 9D:
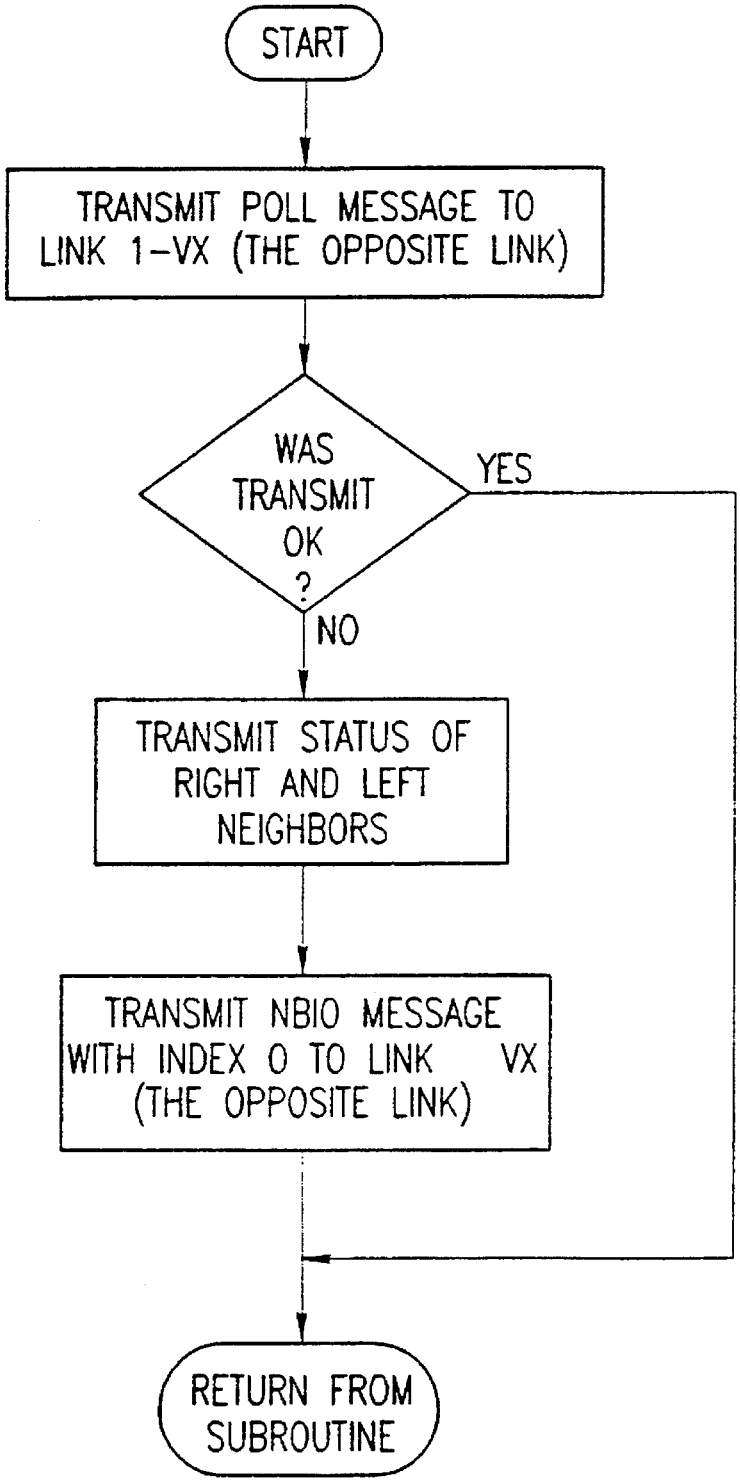
Figure 9E:
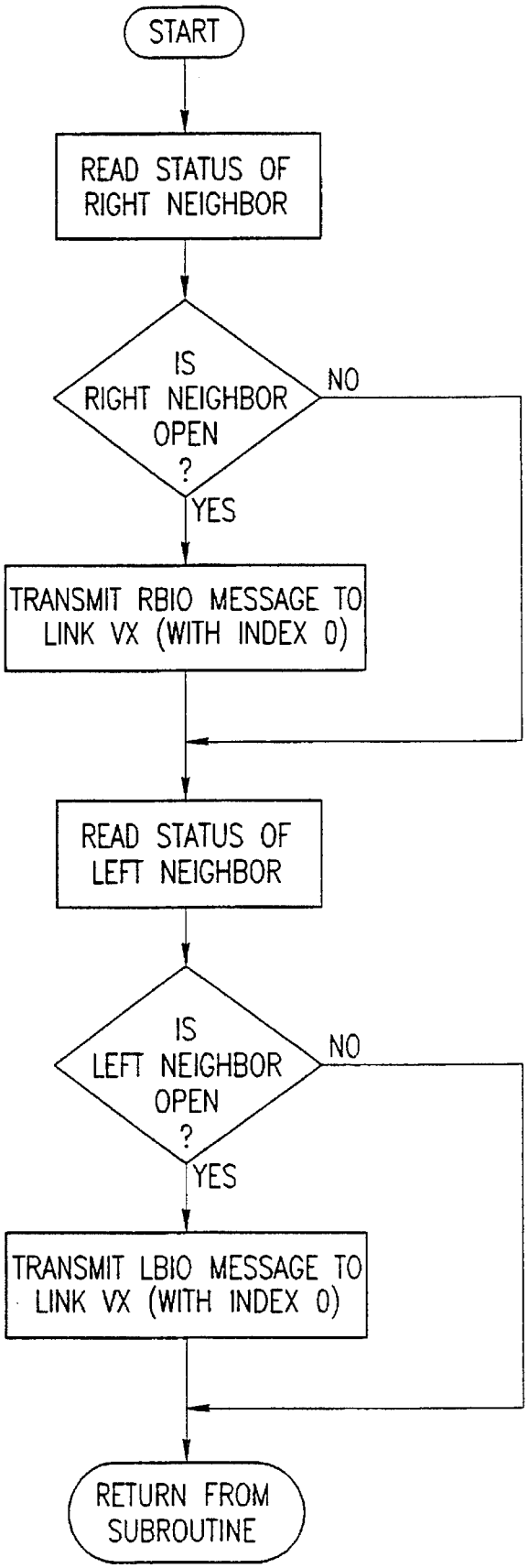
Figure 9F:
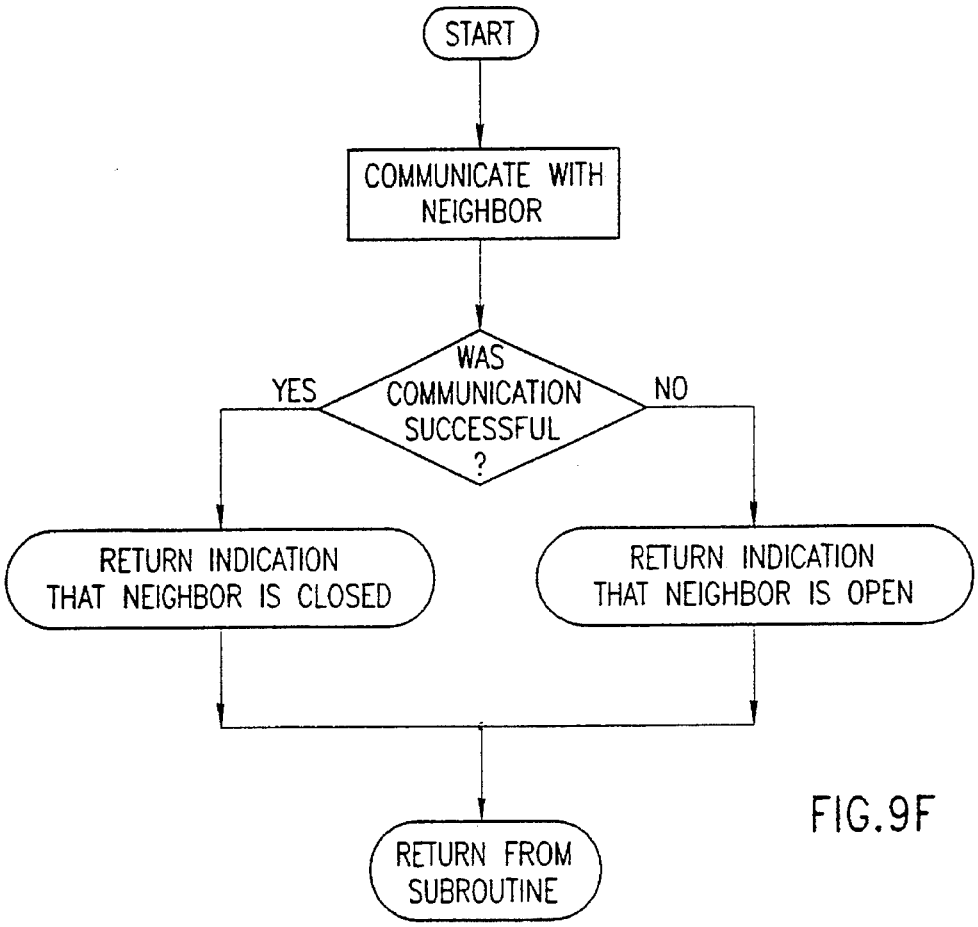
Figure 9G:
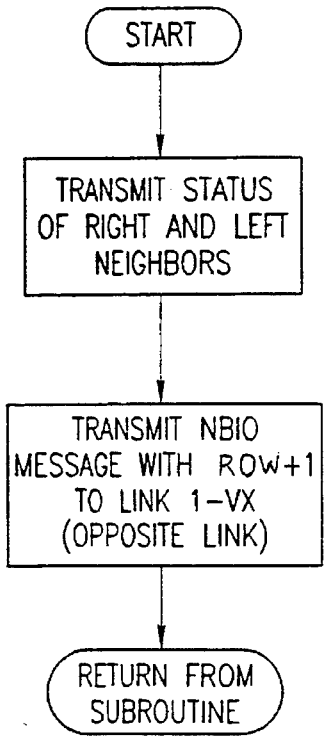
Figure 9H:
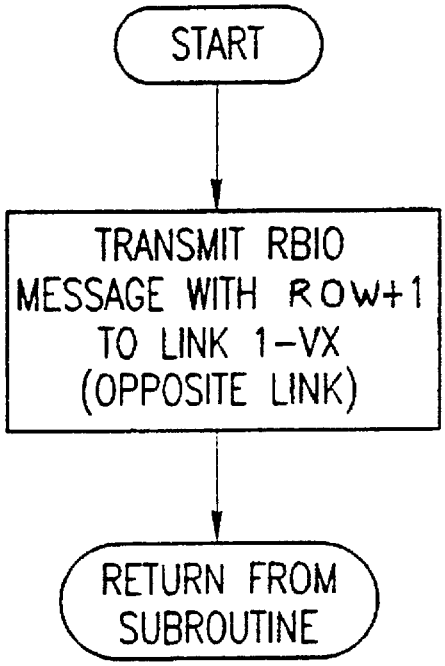
Figure 9I:
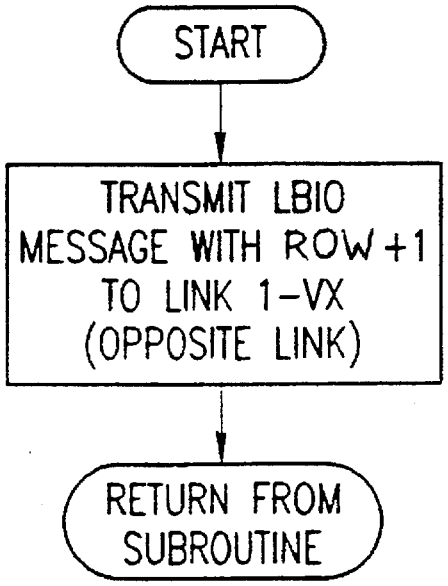

The description of the handling of the various types of messages is provided with reference to the drawings in accordance with the following table:

| MESSAGE TYPE | FIGURE |
|---|---|
| POLL | FIG. 9D |
| NBIO | FIG. 9G |
| RBIO | FIG. 9H |
| LBIO | FIG. 9I |

FIG. 9D illustrates handling of a POLL message from a LINK VX and indicates that the received POLL message is retransmitted to an opposite link, LINK 1-VX. If the transmission is not successful, the DCU transmits the status of its right and left neighbors back to link VX and also transmits an NBIO message with index 0 to link VX.

Transmission of the status of the right and left neighbors is illustrated in FIG. 9E. An inquiry is made as to whether the right neighbor door is open. If so, an RBIO message is transmitted to link VX with index 0. An inquiry is made if the left neighbor door is open. If so, an LBIO message is transmitted to link VX with index 0.

Reading status of a neighbor is illustrated in FIG. 9F and includes the steps of communicating with a neighboring DCU. If the communication is successful, an indication is provided that the neighboring door is closed. If the communication is not successful, an indication is provided that the neighboring door is open.

Handling of an NBIO message is illustrated in FIG. 9G and includes transmitting the status of the right and left neighbors as described hereinabove and afterwards transmitting an NBIO message with an ROW index incremented by +1 to the opposite link 1-VX.

Handling of an RBIO message is illustrated in FIG. 9H and includes transmitting an RBIO message with a ROW index incremented by +1 to the opposite link 1-VX.

Handling of an LBIO message is illustrated in FIG. 9I and includes transmitting an LBIO message with an ROW index incremented by +1 to the opposite link 1-VX.

It will be appreciated by persons skilled in the art that the present invention is not limited by what has been particularly shown and described hereinabove. Rather the scope of the present invention is defined only by the claims which follow:

APPENDIX A

Hex File Dump of Door Control Unit (DCU)

```
:10000300750801E508D39404500878087407 40126F6AE
:1000130050F122C2A7D200750A00E50AD394075013
:100023004A750BFFA294400A150BE50B700201E819
:1000330080F2E5095401B40103D38001C39201A204
:100043000192A7A200300101B39200750BFFA294A5
:10005300B3400A150BE50B700201E880F1E509C313
:1000630013F509780A740126F650AF750BFFA294B5
:10007300400A150BE50B7002806B80F2A20092A779
:10008300750BFFA294B3400A150BE50B7002805564
:1000930080F1750BFFA294400A150BE50B700280EB
:1000A3004480F2A200B392A7750BFFA294B3400A57
:1000B300150BE50B7002802D80F1750BFFA29440A8
:1000C3000A150BE50B7002801C80F2D2A7750BFF9B
:1000D300A294B3400A150BE50B7002800880F1115E
:1000E300031103D322D2A7C322C2A5D200750A00EB
:1000F300E50AD39407504A750BFFA297400A150BE4
:10010300E50B700221BE80F2E5095401B40103D36B
:100113008001C39201A20192A5A200300101B39212
:1001230000750BFFA297B3400A150BE50B70022174
:10013300BE80F1E509C313F509780A740126F65068
:10014300AF750BFFA297400A150BE50B7002806B8E
:1001530080F2A20092A5750BFFA297B3400A150B7C
:10016300E50B7002805580F1750BFFA297400A15CD
:100173000BE50B7002804480F2A200B392A5750BCD
:10018300FFA297B3400A150BE50B7002802D80F197
:10019300750BFFA297400A150BE50B7002801C80BC
:1001A300F2D2A5750BFFA297B3400A150BE50B70AE
:1001B30002800880F111031103D322D2A5C322C206
:1001C300A6D200750A00E50AD39407505C750B01AB
:1001D300750C00A295B3400F780B120705E50C458B
:1001E3000B700241DC80ECE5095401B40103D380B8
:1001F30001C39201A20192A6A200300101B39200B1
:10020300750B01750C00A295B3B3400F780B120761
:1002130005E50C450B700241DC80EBE509C313F5E2
:1002230009780A740126F6509D750B01750C00A21E
:1002330095B3400F780B120705E50C450B7002418F
:10024300DC80ECA20092A6750B01750C00A295B39D
:10025300B3400F780B120705E50C450B700280794C
:1002630080EB750B01750C00A295B3400F780B1250
:100273000705E50C450B7002805F80ECA200B3928A
:10028300A6750B01750C00A295B3B3400F780B1242
:100293000705E50C450B7002803F80EB750B01757C
:1002A3000C00A295B3400F780B120705E50C450B24
:1002B3007002802580ECD2A6750B01750C00A29507
:1002C300B3B3400F780B120705E50C450B700280A2
:1002D3000880EB11031103D322D2A6C322C2A4D2F6
:1002E30000750A00E50AD39407505C750B01750C81
:1002F30000A296B3400F780B120705E50C450B706F
:100303000261FA80ECE5095401B40103D38001C30F
:100313009201A20192A4A200300101B39200750BD5
```

Hex Dumps Page 2 of 9 pages

```
:1003230001750C00A296B3B3400F780B120705E5D5
:100333000C450B700261FA80EBE509C313F50978EC
:100343000A740126F6509D750B01750C00A296B335
:10035300400F780B120705E50C450B700261FA801C
:10036300ECA20092A4750B01750C00A296B3B340E6
:100373000F780B120705E50C450B7002807980EBB3
:10038300750B01750C00A296B3400F780B1207058D
:10039300E50C450B7002805F80ECA200B392A4755C
:1003A3000B01750C00A296B3B3400F780B1207052F
:1003B300E50C450B7002803F80EB750B01750C005B
:1003C300A296B3400F780B120705E50C450B70029C
:1003D300802580ECD2A4750B01750C00A296B3B3F3
:1003E300400F780B120705E50C450B70028008805F
:1003F300EB11031103D322D2A4C322A80A7600D29D
:1004030000D202750D01750B00E50BD39407503034
:10041300C2A71103D2A71103A294B39201A201B3FD
:100423004008A80AE6250DA80AF6E50DC333F50D25
:10043300A200300101B39200780B740126F650C973
:10044300C2A71103D2A71103A294300001B3400243
:10045300C202C2A71103D2A71103A294300001B3B1
:100463005002C202C2A71103D2A71103A2945002E1
:10047300C202A20222A80A7600D200D202750D019E
:10048300750B00E50BD394075030C2A51103D2A519
:100493001103A297B39201A201B34008A80AE6256B
:1004A3000DA80AF6E50DC333F50DA200300101B323
:1004B3009200780B740126F650C9C2A51103D2A588
:1004C3001103A297300001B34002C202C2A5110377
:1004D300D2A51103A297300001B35002C202C2A5F4
:1004E3001103D2A51103A2975002C202A20222A8AD
:1004F3000A7600D200D202750D01750B00E50BD30D
:100503009407502FC2A61103D2A61103A2959201FC
:10051300A201B34008A80AE6250DA80AF6E50DC313
:1005230033F50DA200300101B39200780B7401265C
:10053300F650CAC2A61103D2A61103A29530000138
:10054300B35002C202C2A61103D2A61103A200B382
:10055300309501B35002C202C2A61103D2A6110301
:10056300A295B35002C202A20222A80A7600D200C8
:10057300D202750D01750B00E50BD39407502FC202
:10058300A41103D2A41103A2969201A201B34008BD
:10059300A80AE6250DA80AF6E50DC333F50DA2005A
:1005A300300101B39200780B740126F650CAC2A43D
:1005B3001103D2A41103A296300001B35002C20268
:1005C300C2A41103D2A41103A200B3309601B35005
:1005D30002C202C2A41103D2A41103A296B3500211
:1005E300C202A20222E50E9006EC25E073850F09F4
:1005F30085100A71FE22850F0985100A91782285DC
:100603000F0985100A91F222850F0985100AB16D31
:0106130022C4
:0806EC00A1F0A1F9C102C10B4C
:10061400E50D9006F425E073850E09111622850E6A
:100624000911EC22850E0931C222850E0951E022FE
:0806F400C11CC122C128C12E66
:10063400E50F6401F50D74E0F50ED1144032850F19
:100644000D74C0F50ED114920220020CE50F700453
```

Hex Dumps Page 3 of 9 pages

```
:10065400C2808002C287800AE50F7004D2808002C3
:10066400D287E50F64017004C2808002C287800CC7
:10067400E50F64017004D2808002D28722E50F6402
:1006840001F50DE51004F50ED11492022285110E28
:10069400751012750F00B1E85021E51254E0B4E072
:1006A4000BE511F50F851210D134800FE51254E0DB
:1006B400B4C00885110F851210D18122C2AF758094
:1006C400FF7590FF75A0FF75B0FFA294B34009C2F7
:1006D40082751100D191D282A297B34009C2857567
:0806E4001101D191D28580E2E1
:080705000816B6FF02181622C7
:030000000206FCF9
:0906FC0075812175D0000206C0D1
:00000001FF
```

Hex File Dump of Edge Control Unit (ECU)

```
:10000300750801E508D39404500878087407 40126F6AE
:1000130050F122C2A7D200750A00E50AD394075013
:100023004A750BFFA294400A150BE50B700201E819
:1000330080F2E5095401B40103D38001C39201A204
:100043000192A7A200300101B39200750BFFA294A5
:10005300B3400A150BE50B700201E880F1E509C313
:1000630013F509780A740126F650AF750BFFA294B5
:10007300400A150BE50B7002806B80F2A20092A779
:10008300750BFFA294B3400A150BE50B7002805564
:1000930080F1750BFFA294400A150BE50B700280EB
:1000A3004480F2A200B392A7750BFFA294B3400A57
:1000B300150BE50B7002802D80F1750BFFA29440A8
:1000C3000A150BE50B7002801C80F2D2A7750BFF9B
:1000D300A294B3400A150BE50B7002800880F1115E
:1000E300031103D322D2A7C322C2A5D200750A00EB
:1000F300E50AD39407504A750BFFA297400A150BE4
:10010300E50B700221BE80F2E5095401B40103D36B
:100113008001C39201A20192A5A200300101B39212
:1001230000750BFFA297B3400A150BE50B70022174
:10013300BE80F1E509C313F509780A740126F65068
:10014300AF750BFFA297400A150BE50B7002806B8E
:1001530080F2A20092A5750BFFA297B3400A150B7C
:10016300E50B7002805580F1750BFFA297400A15CD
:100173000BE50B7002804480F2A200B392A5750BCD
:10018300FFA297B3400A150BE50B7002802D80F197
:10019300750BFFA297400A150BE50B7002801C80BC
:1001A300F2D2A5750BFFA297B3400A150BE50B70AE
:1001B30002800880F111031103D322D2A5C322C206
:1001C300A6D200750A00E50AD39407505C750B01AB
:1001D300750C00A295B3400F780B1207C9E50C45C7
:1001E3000B700241DC80ECE5095401B40103D380B8
:1001F30001C39201A20192A6A200300101B39200B1
:10020300750B01750C00A295B3B3400F780B120761
:10021300C9E50C450B700241DC80EBE509C313F51E
:1002230009780A740126F6509D750B01750C00A21E
:1002330095B3400F780B1207C9E50C450B700241CB
:10024300DC80ECA20092A6750B01750C00A295B39D
:10025300B3400F780B1207C9E50C450B7002807988
:1002630080EB750B01750C00A295B3400F780B1250
:1002730007C9E50C450B7002805F80ECA200B392C6
:10028300A6750B01750C00A295B3B3400F780B1242
:1002930007C9E50C450B7002803F80EB750B0175B8
:1002A3000C00A295B3400F780B1207C9E50C450B60
:1002B3007002802580ECD2A6750B01750C00A29507
:1002C300B3B3400F780B1207C9E50C450B700280DE
:1002D3000880EB11031103D322D2A6C322C2A4D2F6
:1002E30000750A00E50AD39407505C750B01750C81
:1002F30000A296B3400F780B1207C9E50C450B70AB
:100303000261FA80ECE5095401B40103D38001C30F
:100313009201A20192A4A200300101B39200750BD5
```

Hex Dumps Page 5 of 9 pages

```
:1003230001750C00A296B3B3400F780B1207C9E511
:100333000C450B700261FA80EBE509C313F50978EC
:100343000A740126F6509D750B01750C00A296B335
:10035300400F780B1207C9E50C450B700261FA8058
:10036300ECA20092A4750B01750C00A296B3B340E6
:100373000F780B1207C9E50C450B7002807980EBEF
:10038300750B01750C00A296B3400F780B1207C9C9
:10039300E50C450B7002805F80ECA200B392A4755C
:1003A3000B01750C00A296B3B3400F780B1207C96B
:1003B300E50C450B7002803F80EB750B01750C005B
:1003C300A296B3400F780B1207C9E50C450B7002D8
:1003D300802580ECD2A4750B01750C00A296B3B3F3
:1003E300400F780B1207C9E50C450B70028008809B
:1003F300EB11031103D322D2A4C322A80A7600D29D
:1004030000D202750D01750B00E50BD39407503034
:10041300C2A71103D2A71103A294B39201A201B3FD
:100423004008A80AE6250DA80AF6E50DC333F50D25
:10043300A200300101B39200780B740126F650C973
:10044300C2A71103D2A71103A294300001B3400243
:10045300C202C2A71103D2A71103A294300001B3B1
:100463005002C202C2A71103D2A71103A2945002E1
:10047300C202A20222A80A7600D200D202750D019E
:10048300750B00E50BD394075030C2A51103D2A519
:100493001103A297B39201A201B34008A80AE6256B
:1004A3000DA80AF6E50DC333F50DA200300101B323
:1004B3009200780B740126F650C9C2A51103D2A588
:1004C3001103A297300001B34002C202C2A5110377
:1004D300D2A51103A297300001B35002C202C2A5F4
:1004E3001103D2A51103A2975002C202A20222A8AD
:1004F3000A7600D200D202750D01750B00E50BD30D
:100503009407502FC2A61103D2A61103A2959201FC
:10051300A201B34008A80AE6250DA80AF6E50DC313
:1005230033F50DA200300101B39200780B7401265C
:10053300F650CAC2A61103D2A61103A29530000138
:10054300B35002C202C2A61103D2A61103A200B382
:10055300309501B35002C202C2A61103D2A6110301
:10056300A295B35002C202A20222A80A7600D200C8
:10057300D202750D01750B00E50BD39407502FC202
:10058300A41103D2A41103A2969201A201B34008BD
:10059300A80AE6250DA80AF6E50DC333F50DA2005A
:1005A300300101B39200780B740126F650CAC2A43D
:1005B3001103D2A41103A296300001B35002C20268
:1005C300C2A41103D2A41103A200B3309601B35005
:1005D30002C202C2A41103D2A41103A296B3500211
:1005E300C202A20222E50E9007A725E073850F0938
:1005F30085100A71FE22850F0985100A91782285DC
:100603000F0985100A91F222850F0985100AB16D31
:0106130022C4
:0807A700A1F0A1F9C102C10B90
:10061400E50D9007AF25E073850E09111622850EAE
:100624000911EC22850E0931C222850E0951E022FE
:0807AF00C11CC122C128C12EAA
:10063400C287D286751500750D0074E0F50ED114CD
:1006440050457515FF75130F7514A0A294B3500689
```

Hex Dumps Page 6 of 9 pages

```
:10065400E514451370028007781312 07C980EC75FE
:100664000E00751012750F00B1E8C0D0E5144513E3
:100674006003D38001C392F0D0D082F05007E5121A
:1006840004541FF515804E750D0174E0F50ED11458
:1006940050437515FF75130F7514A0A297B3500638
:1006A400E514451370028007781312 07C980EC75AE
:1006B4000E01751012750F00B1E8C0D0E514451392
:1006C4006003D38001C392F0D0D082F05007E512CA
:1006D40004541FF515E51564FF601685110DE51525
:1006E400232354FC24E0F50ED1149203300302C2F8
:1006F40086D28722E5166401F50DE517F50ED114AF
:1007040050028011E516F511D13485160D74D0F51B
:100714000ED114920422E50F6401F50DE51004F5E1
:100724000ED114920222E5166401F511D134E516B6
:100734006401F50DE51704F50ED114920422851811
:100744000E751019750F00B1E85035E51954F0F520
:100754001AE51AB4E00CE518F50FE519F510F11ACD
:10076400801EE51AB4F00CE518F516E519F517D155
:10077400F8800DE51AB4D008851816851917F12AE2
:1007840022C2AF7580FF7590FF75A0FF75B0FFA200
:1007940096400575180 3F142A2954005751802F1BB
:0307A4004280ECA4
:1008000075892075884 0758DF3758BF375987275B1
:10081000870022A298400280FA859921C298E5219A
:1008200022A2985018859923C298E523B4130CE5A9
:10083000236411600611 13F52380F480E4A299402B
:100840000280DEC299852299227526 00E52685243C
:1008500083852582120 7B7E4936015E526852483F6
:1008600085258212 07B7E493F5221121052680DC45
:010870002265
:0907B7002582F58250020583221F
:0807C9000816B6FF0218162203
:030000000207C034
:0907C00075812775D00002078540
:00000001FF
```

Hex Dumps Page 7 of 9 pages

Hex File Dump of Site Control Unit (SCU)

```
:0E07F0004258004E520040400045500D0A0095
:10000300752101E521D3940B50087821740126F65C
:1000130050F122C2A7D203752300E523D3940750DE
:100023004A7524FFA294400A1524E524700201E8CE
:1000330080F2E5225401B40103D38001C39204A2E8
:100043000492A7A203300401B392037524FFA29480
:10005300B3400A1524E524700201E880F1E522C3C8
:1000630013F5227823740126F650AF7524FFA2946A
:10007300400A1524E5247002806B80F2A20392A744
:100083007524FFA294B3400A1524E5247002805519
:1000930080F17524FFA294400A1524E524700280A0
:1000A3004480F2A203B392A77524FFA294B3400A3B
:1000B3001524E5247002802D80F17524FFA294405D
:1000C3000A1524E5247002801C80F2D2A77524FF50
:1000D300A294B3400A1524E5247002800880F1112C
:1000E300031103D322D2A7C322C2A5D203752300CF
:1000F300E523D39407504A7524FFA297400A152499
:10010300E524700221BE80F2E5225401B40103D339
:100113008001C39204A20492A5A203300401B39206
:10012300037524FFA297B3400A1524E52470022126
:10013300BE80F1E522C313F5227823740126F6501D
:10014300AF7524FFA297400A1524E5247002806B43
:1001530080F2A20392A57524FFA297B3400A152447
:10016300E5247002805580F17524FFA297400A159B
:1001730024E5247002804480F2A203B392A575247F
:10018300FFA297B3400A1524E5247002802D80F165
:100193007524FFA297400A1524E5247002801C8071
:1001A300F2D2A57524FFA297B3400A1524E5247063
:1001B30002800880F111031103D322D2A5C322C206
:1001C300A6D203752300E523D39407505C7524025C
:1001D3007525C0A295B3400F7824120810E5254574
:1001E30024700241DC80ECE5225401B40103D38086
:1001F30001C39204A20492A6A203300401B39203A2
:10020300752402752 5C0A295B3B3400F7824120854
:1002130010E5254524700241DC80EBE522C313F58C
:10022300227823740126F6509D7524027525C0A2F9
:1002330095B3400F7824120810E525452470024138
:10024300DC80ECA20392A67524027525C0A295B3A7
:10025300B3400F7824120810E525452470028079F5
:1002630080EB7524027525C0A295B3400F78241244
:100273000810E52545247002805F80ECA203B39249
:10028300A67524027525C0A295B3B3400F78241236
:100293000810E52545247002803F80EB7524027524
:1002A30025C0A295B3400F7824120810E5254524F4
:1002B3007002802580ECD2A67524027525C0A29514
:1002C300B3B3400F7824120810E52545247002804B
:1002D3000880EB11031103D322D2A6C322C2A4D2F6
:1002E30003752300E523D39407505C752402752519
:1002F300C0A296B3400F7824120810E52545247058
:100303000261FA80ECE5225401B40103D38001C3F6
```

Hex Dumps Page 8 of 9 pages

```
:100313009204A20492A4A203300401B392037524AD
:10032300027525C0A296B3B3400F7824120810E5D6
:100333002545247002 61FA80EBE522C313F5227888
:100343002374012 6F6509D7524027525C0A296B329
:10035300400F7824120810E5254524700261FA80C5
:10036300ECA20392A47524027525C0A296B3B340F0
:100373000F7824120810E52545247002807980EB5C
:100383007524027525C0A296B3400F782412081075
:10039300E52545247002805F80ECA203B392A47527
:1003A30024027525C0A296B3B3400F782412081017
:1003B300E52545247002803F80EB7524027525C036
:1003C300A296B3400F7824120810E5254524700245
:1003D300802580ECD2A47524027525C0A296B3B300
:1003E300400F7824120810E525452470028008 8008
:1003F300EB11031103D322D2A4C322A8237600D284
:1004030003D205752601752400E524D394075030E3
:10041300C2A71103D2A71103A294B39204A204B3F7
:100423004008A823E62526A823F6E526C333F526A8
:10043300A203300401B392037824740126F650C951
:10044300C2A71103D2A71103A294300301B3400240
:10045300C205C2A71103D2A71103A294300301B3AB
:100463005002C205C2A71103D2A71103A2945002DE
:10047300C205A20522A8237600D203D20575260160
:10048300752400E524D394075030C2A51103D2A5E7
:100493001103A297B39204A204B34008A823E6254C
:1004A30026A823F6E526C333F526A203300401B3B9
:1004B300920378247401 26F650C9C2A51103D2A56C
:1004C3001103A297300301B34002C205C2A5110371
:1004D300D2A51103A297300301B35002C205C2A5EE
:1004E3001103D2A51103A2975002C205A20522A8A7
:1004F300237600D203D205752601752400E524D3A3
:100503009407502FC2A61103D2A61103A2959204F9
:10051300A204B34008A823E62526A823F6E526C3AC
:1005230033F526A203300401B39203782474012621
:10053300F650CAC2A61103D2A61103A29530030135
:10054300B35002C205C2A61103D2A61103A203B37C
:1005530030950 1B35002C205C2A61103D2A61103FE
:10056300A295B35002C205A20522A8237600D203A6
:10057300D205752601752400E524D39407502FC2B4
:10058300A41103D2A41103A2969204A204B34008B7
:10059300A823E62526A823F6E526C333F526A203DA
:1005A300300401B392037824740126F650CAC2A41E
:1005B3001103D2A41103A296300301B35004C280E5
:1005C300C205C2A41103D2A41103A203B33096013E
:1005D300B35004C281C205C2A41103D2A41103A261
:1005E30096B35004C282C205A20522E52790076F85
:1005F30025E07385282285292371FE2285282285FB
:1006030029239178228528228529239 1F22285287E
:07061300228529 23B16D22AD
:08076F00A1F6A1FFC108C111B0
:10061A00E52690077725E07385272211162285277C
:10062A002211EC2285272231C22285272251E0227B
:08077700C122C128C12EC134CA
:10063A00C2AF7580FF7590FF75A0FF75B0FF1207F6
```

Hex Dumps Page 9 of 9 pages

```
:10064A007F750851E50864506005E508B4700280BA
:10065A0007120792F50880EC750A00D286D28774D1
:10066A0002F52674F0F527D11A5007D2027509024D
:10067A00801E7403F52674F0F527D11A5007D202AA
:10068A00750903800BC202751C07751DF01207C895
:10069A00200202E16DC201A201407D750BEA750CD0
:1006AA0060C200A200402BE509B40308A296B3B3C6
:1006BA004002D200E509B40208A295B3B34002D2BF
:1006CA0000780B120810E50C450B7004D200D20119
:1006DA0080D1E50C450B700B751C07751DF31207CD
:1006EA00C8803385092775290D752800B1EE502475
:1006FA00E50D54F0B4D004D2018017E50D54F0B4DE
:10070A00E010E50D540FFEE50A240FF8A606050AC7
:10071A00C2868002C287C1A1751C07751DF6120721
:10072A00C8E50A6035750E00E50A14C3950E402A1D
:10073A00E50E240FF8E654032430F51A1207A0E553
:10074A000E240FF8E60303543F54032430F51A121B
:10075A0007A0780E740126F650CE751C07751DF990
:05076A001207C8C14B9D
:10077F0075892075884075 8DF3758BF37598727533
:10078F00870022A298400280FA859919C298E5192C
:10079F0022A298501885991BC298E51BB4130CE53B
:1007AF001B64116006F192F51B80F480E4A299405E
:1007BF000280DEC299851A9922751E00E51E851CDE
:1007CF0083851D821207FEE4936015E51E851C8349
:1007DF00851D821207FEE493F51AF1A0051E80DC39
:0107EF0022E7
:0907FE002582F5825002058322D8
:080810000816B6FF02181622BB
:03000000020807EC
:0908070075812A75D00002063A41
:00000001FF
```

Sequence of Events

This document describes the sequence of events which occurs in the system for each of the following cases:

- Case 1 - All doors closed
- Case 2 - A single authorized door is open
- Case 3 - A single unauthorized door is open
- Case 4 - Two doors are open, one is authorized and one is not.

For the purpose of this description the system includes the following elements:

- A system manager
- A Single SCU which is connected to the ECU labeled ECU1.
- Four ECUs and 16 DCU which are configures in the following manner:

| | | | |
|---|---|---|---|
| DCU4.4 | DCU3.4 | DCU2.4 | DCU1.4 |
| DCU4.3 | DCU3.3 | DCU2.3 | DCU1.3 |
| DCU4.2 | DCU3.2 | DCU2.2 | DCU1.2 |
| DCU4.1 | DCU3.1 | DCU2.1 | DCU1.1 |
| ECU4 | ECU3 | ECU2 | ECU1 |

Case 1 - All Doors Closed

| | SOURCE | DEST. | MESSAGE CONTENTS |
|---|---|---|---|
| 1. | System | SCU | POLL |
| 2. | SCU | Right Link | POLL (Transmission fails) |
| 3. | SCU | ECU1 | POLL |
| | | | |
| 4. | ECU1 | ECU2 | POLL |
| 5. | ECU2 | ECU3 | POLL |
| 6. | ECU3 | ECU4 | POLL |
| 7. | ECU4 | Next ECU | POLL (Transmission fails) |
| | | | |
| 8. | ECU4 | DCU4.1 | POLL |
| 9. | DCU4.1 | DCU4.2 | POLL |
| 10. | DCU4.2 | DCU4.3 | POLL |
| 11. | DCU4.3 | DCU4.4 | POLL |
| 12. | DCU4.4 | Next DCU | POLL (Transmission fails) |
| | | | |
| 13. | DCU4.4 | DCU3.4 | ARE YOU THERE? |
| 14. | DCU3.4 | DCU4.4 | YES |
| 15. | DCU4.4 | DCU4.3 | NBIO 0 |
| 16. | DCU4.3 | DCU3.3 | ARE YOU THERE? |
| 17. | DCU3.3 | DCU4.3 | YES |
| 18. | DCU4.3 | DCU4.2 | NBIO 1 |
| 19. | DCU4.2 | DCU3.2 | ARE YOU THERE? |
| 20. | DCU3.2 | DCU4.2 | YES |
| 21. | DCU4.2 | DCU4.1 | NBIO 2 |

Sequences

| | | | |
|---|---|---|---|
| 22. | DCU4.1 | DCU3.1 | ARE YOU THERE? |
| 23. | DCU3.1 | DCU4.1 | YES |
| 24. | DCU4.1 | ECU4 | NBIO 3 |
| | | | |
| 25. | ECU4 | ECU3 | NBIO 4,0 |
| 26. | ECU3 | ECU2 | NBIO 4,1 |
| 27. | ECU2 | ECU1 | NBIO 4,2 |
| 28. | ECU1 | SCU | NBIO 4,3 |
| 29. | SCU | System | NBIO 4,3; The system interprets this to mean that DCU4.4 could not communicate with a DCU above it. Knowing that the current topology is a 4 by 4 matrix, the system does not sound the alarm. |
| 30. | ECU4 | ECU3 | ENDP 0 |
| 31. | | | |
| 32. | ECU3 | DCU3.1 | POLL |
| 33. | DCU3.1 | DCU3.2 | POLL |
| 34. | DCU3.2 | DCU3.3 | POLL |
| 35. | DCU3.3 | DCU3.4 | POLL |
| 36. | DCU3.4 | Next DCU | POLL (Transmission fails) |
| | | | |
| 37. | DCU3.4 | DCU4.4 | ARE YOU THERE? |
| 38. | DCU4.4 | DCU3.4 | YES |
| 39. | DCU3.4 | DCU2.4 | ARE YOU THERE? |
| 40. | DCU2.4 | DCU3.4 | YES |
| 41. | DCU3.4 | DCU3.3 | NBIO 0 |
| 42. | DCU3.3 | DCU4.3 | ARE YOU THERE? |
| 43. | DCU4.3 | DCU3.3 | YES |
| 44. | DCU3.3 | DCU2.3 | ARE YOU THERE? |
| 45. | DCU2.3 | DCU3.3 | YES |
| 46. | DCU3.3 | DCU3.2 | NBIO 1 |
| 47. | DCU3.2 | DCU4.2 | ARE YOU THERE? |
| 48. | DCU4.2 | DCU3.2 | YES |
| 49. | DCU3.2 | DCU2.2 | ARE YOU THERE? |
| 50. | DCU2.2 | DCU3.2 | YES |
| 51. | DCU3.2 | DCU3.1 | NBIO 2 |
| 52. | DCU3.1 | DCU4.1 | ARE YOU THERE? |
| 53. | DCU4.1 | DCU3.1 | YES |
| 54. | DCU3.1 | DCU2.1 | ARE YOU THERE? |
| 55. | DCU2.1 | DCU3.1 | YES |
| 56. | DCU3.1 | ECU3 | NBIO 3 |
| | | | |
| 57. | ECU3 | ECU2 | NBIO 4,0 |
| 58. | ECU2 | ECU1 | NBIO 4,1 |
| 59. | ECU1 | SCU | NBIO 4,2 |
| 60. | SCU | System | NBIO 4,2; The system interprets this to mean that DCU3.4 could not communicate with the DCU above it. Knowing that the current topology is a 4 by 4 matrix, the system does not sound the alarm. |
| 61. | ECU3 | ECU2 | ENDP 1 |
| | | | |
| 62. | ECU2 | DCU2.1 | POLL |

| | | | |
|---|---|---|---|
| 63. | DCU2.1 | DCU2.2 | POLL |
| 64. | DCU2.2 | DCU2.3 | POLL |
| 65. | DCU2.3 | DCU2.4 | POLL |
| 66. | DCU2.4 | Next DCU | POLL (Transmission fails) |
| | | | |
| 67. | DCU2.4 | DCU3.4 | ARE YOU THERE? |
| 68. | DCU3.4 | DCU2.4 | YES |
| 69. | DCU2.4 | DCU1.4 | ARE YOU THERE? |
| 70. | DCU1.4 | DCU2.4 | YES |
| 71. | DCU2.4 | DCU2.3 | NBIO 0 |
| 72. | DCU2.3 | DCU3.3 | ARE YOU THERE? |
| 73. | DCU3.3 | DCU2.3 | YES |
| 74. | DCU2.3 | DCU1.3 | ARE YOU THERE? |
| 75. | DCU1.3 | DCU2.3 | YES |
| 76. | DCU2.3 | DCU2.2 | NBIO 1 |
| 77. | DCU2.2 | DCU3.2 | ARE YOU THERE? |
| 78. | DCU3.2 | DCU2.2 | YES |
| 79. | DCU2.2 | DCU1.2 | ARE YOU THERE? |
| 80. | DCU1.2 | DCU2.2 | YES |
| 81. | DCU2.2 | DCU2.1 | NBIO 2 |
| 82. | DCU2.1 | DCU3.1 | ARE YOU THERE? |
| 83. | DCU3.1 | DCU2.1 | YES |
| 84. | DCU2.1 | DCU1.1 | ARE YOU THERE? |
| 85. | DCU1.1 | DCU2.1 | YES |
| 86. | DCU2.1 | ECU2 | NBIO 3 |
| | | | |
| 87. | ECU2 | ECU1 | NBIO 4,0 |
| 88. | ECU1 | SCU | NBIO 4,1 |
| 89. | SCU | System | NBIO 4,1; The system interprets this to mean that DCU2.4 could not communicate with the DCU above it. Knowing that the current topology is a 4 by 4 matrix, the system does not sound the alarm. |
| 90. | ECU2 | ECU1 | ENDP 2 |
| | | | |
| 91. | ECU1 | DCU1.1 | POLL |
| 92. | DCU1.1 | DCU1.2 | POLL |
| 93. | DCU1.2 | DCU1.3 | POLL |
| 94. | DCU1.3 | DCU1.4 | POLL |
| 95. | DCU1.4 | Next DCU | POLL (Transmission fails) |
| | | | |
| 96. | DCU1.4 | DCU2.4 | ARE YOU THERE? |
| 97. | DCU2.4 | DCU1.4 | YES |
| 98. | DCU1.4 | DCU1.3 | NBIO 0 |
| 99. | DCU1.3 | DCU2.3 | ARE YOU THERE? |
| 100. | DCU2.3 | DCU1.3 | YES |
| 101. | DCU1.3 | DCU1.2 | NBIO 1 |
| 102. | DCU1.2 | DCU2.2 | ARE YOU THERE? |
| 103. | DCU2.2 | DCU1.2 | YES |
| 104. | DCU1.2 | DCU1.1 | NBIO 2 |
| 105. | DCU1.1 | DCU2.1 | ARE YOU THERE? |
| 106. | DCU2.1 | DCU1.1 | YES |

| | | | |
|---|---|---|---|
| 107. | DCU1.1 | ECU1 | NBIO 3 |
| | | | |
| 108. | ECU1 | SCU | NBIO 4,0 |
| 109. | SCU | System | NBIO 4,0; The system interprets this to mean that DCU1.4 could not communicate with the DCU above it. Knowing that the current topology is a 4 by 4 matrix, the system does not sound the alarm. |
| 110. | ECU1 | SCU | ENDP 3 |
| 111. | SCU | System | ENDP 3; The system interprets this to mean that the polling of 4 columns has been completed. Knowing that the current topology is a 4 by 4 matrix, the system does not sound the alarm. |

Case 2 - A Single Authorized Door is Open

The door to which DCU2.3 is attached is open. This door has been authorized to be open.

| | SOURCE | DEST. | MESSAGE CONTENTS |
|---|---|---|---|
| 1. | System | SCU | POLL |
| 2. | SCU | Right Link | POLL (Transmission fails) |
| 3. | SCU | ECU1 | POLL |
| | | | |
| 4. | ECU1 | ECU2 | POLL |
| 5. | ECU2 | ECU3 | POLL |
| 6. | ECU3 | ECU4 | POLL |
| 7. | ECU4 | Next ECU | POLL (Transmission fails) |
| | | | |
| 8. | ECU4 | DCU4.1 | POLL |
| 9. | DCU4.1 | DCU4.2 | POLL |
| 10. | DCU4.2 | DCU4.3 | POLL |
| 11. | DCU4.3 | DCU4.4 | POLL |
| 12. | DCU4.4 | Next DCU | POLL (Transmission fails) |
| | | | |
| 13. | DCU4.4 | DCU3.4 | ARE YOU THERE? |
| 14. | DCU3.4 | DCU4.4 | YES |
| 15. | DCU4.4 | DCU4.3 | NBIO 0 |
| 16. | DCU4.3 | DCU3.3 | ARE YOU THERE? |
| 17. | DCU3.3 | DCU4.3 | YES |
| 18. | DCU4.3 | DCU4.2 | NBIO 1 |
| 19. | DCU4.2 | DCU3.2 | ARE YOU THERE? |
| 20. | DCU3.2 | DCU4.2 | YES |
| 21. | DCU4.2 | DCU4.1 | NBIO 2 |
| 22. | DCU4.1 | DCU3.1 | ARE YOU THERE? |
| 23. | DCU3.1 | DCU4.1 | YES |
| 24. | DCU4.1 | ECU4 | NBIO 3 |
| | | | |
| 25. | ECU4 | ECU3 | NBIO 4,0 |
| 26. | ECU3 | ECU2 | NBIO 4,1 |
| 27. | ECU2 | ECU1 | NBIO 4,2 |
| 28. | ECU1 | SCU | NBIO 4,3 |
| 29. | SCU | System | NBIO 4,3; The system interprets this to mean that DCU3.4 could not communicate with the DCU above it. Knowing that the current topology is a 4 by 4 matrix, the system does not sound the alarm. |
| 30. | ECU4 | ECU3 | ENDP 0 |
| | | | |
| 31. | ECU3 | DCU3.1 | POLL |
| 32. | DCU3.1 | DCU3.2 | POLL |
| 33. | DCU3.2 | DCU3.3 | POLL |
| 34. | DCU3.3 | DCU3.4 | POLL |
| 35. | DCU3.4 | Next DCU | POLL (Transmission fails) |
| | | | |
| 36. | DCU3.4 | DCU4.4 | ARE YOU THERE? |

| | | | |
|---|---|---|---|
| 37. | DCU4.4 | DCU3.4 | YES |
| 38. | DCU3.4 | DCU2.4 | ARE YOU THERE? |
| 39. | DCU2.4 | DCU3.4 | YES |
| 40. | DCU3.4 | DCU3.3 | NBIO 0 |
| 41. | DCU3.3 | DCU4.3 | ARE YOU THERE? |
| 42. | DCU4.3 | DCU3.3 | YES |
| 43. | DCU3.3 | DCU2.3 | ARE YOU THERE? (Transmission fails) |
| 44. | DCU3.3 | DCU3.2 | RBIO 0 |
| 45. | DCU3.2 | DCU3.1 | RBIO 1 |
| 46. | DCU3.1 | ECU3 | RBIO 2 |
| 47. | ECU3 | ECU2 | RBIO 3,0 |
| 48. | ECU2 | ECU1 | RBIO 3,1 |
| 49. | ECU1 | SCU | RBIO 3,2 |
| 50. | SCU | System | RBIO 3,2; The system interprets this to mean that DCU3.3 could not communicate with the DCU to its right. Knowing that the current topology is a 4 by 4 matrix, the system concludes that the door to which DCU2.3 is attached is open. Because this door is authorized to open, the system logs the event but does not sound the alarm. |
| 51. | DCU3.3 | DCU3.2 | NBIO 1 |
| 52. | DCU3.2 | DCU4.2 | ARE YOU THERE? |
| 53. | DCU4.2 | DCU3.2 | YES |
| 54. | DCU3.2 | DCU2.2 | ARE YOU THERE? |
| 55. | DCU2.2 | DCU3.2 | YES |
| 56. | DCU3.2 | DCU3.1 | NBIO 2 |
| 57. | DCU3.1 | DCU4.1 | ARE YOU THERE? |
| 58. | DCU4.1 | DCU3.1 | YES |
| 59. | DCU3.1 | DCU2.1 | ARE YOU THERE? |
| 60. | DCU2.1 | DCU3.1 | YES |
| 61. | DCU3.1 | ECU3 | NBIO 3 |
| | | | |
| 62. | ECU3 | ECU2 | NBIO 4,0 |
| 63. | ECU2 | ECU1 | NBIO 4,1 |
| 64. | ECU1 | SCU | NBIO 4,2 |
| 65. | SCU | System | NBIO 4,2; The system interprets this to mean that DCU3.4 could not communicate with the DCU above it. Knowing that the current topology is a 4 by 4 matrix, the system does not sound that alarm. |
| 66. | ECU3 | ECU2 | ENDP 1 |
| | | | |
| 67. | ECU2 | DCU2.1 | POLL |
| 68. | DCU2.1 | DCU2.2 | POLL |
| 69. | DCU2.2 | DCU2.3 | POLL (Transmission fails) |
| | | | |
| 70. | DCU2.2 | DCU3.2 | ARE YOU THERE? |
| 71. | DCU3.2 | DCU2.2 | YES |
| 72. | DCU2.2 | DCU1.2 | ARE YOU THERE? |
| 73. | DCU1.2 | DCU2.2 | YES |
| 74. | DCU2.2 | DCU2.1 | NBIO 0 |
| 75. | DCU2.1 | DCU3.1 | ARE YOU THERE? |

Sequences

| | | | |
|---|---|---|---|
| 76. | DCU3.1 | DCU2.1 | YES |
| 77. | DCU2.1 | DCU1.1 | ARE YOU THERE? |
| 78. | DCU1.1 | DCU2.1 | YES |
| 79. | DCU2.1 | ECU2 | NBIO 1 |
| | | | |
| 80. | ECU2 | ECU1 | NBIO 2,0 |
| 81. | ECU1 | SCU | NBIO 2,1 |
| 82. | SCU | System | NBIO 2,1; The system interprets this to mean that DCU2.2 could not communicate with the DCU above it. Knowing that the current topology is a 4 by 4 matrix, the system concludes that the door to which DCU2.3 is attached is open. Since this door is authorized to be open, the system logs the event but does not sound the alarm. |
| 83. | ECU2 | ECU1 | ENDP 2 |
| | | | |
| 84. | ECU1 | DCU1.1 | POLL |
| 85. | DCU1.1 | DCU1.2 | POLL |
| 86. | DCU1.2 | DCU1.3 | POLL |
| 87. | DCU1.3 | DCU1.4 | POLL |
| 88. | DCU1.4 | Next DCU | POLL (Transmission fails) |
| | | | |
| 89. | DCU1.4 | DCU2.4 | ARE YOU THERE? |
| 90. | DCU2.4 | DCU1.4 | YES |
| 91. | DCU1.4 | DCU1.3 | NBIO 0 |
| 92. | DCU1.3 | DCU2.3 | ARE YOU THERE? (Transmission fails) |
| 93. | DCU1.3 | DCU1.2 | LBIO 0 |
| 94. | DCU1.2 | DCU1.1 | LBIO 1 |
| 95. | DCU1.1 | ECU1 | LBIO 2 |
| 96. | ECU1 | SCU | LBIO 3,0 |
| 97. | SCU | System | LBIO 3,0; The system interprets this to mean that DCU1.3 could not communicate with the DCU to its left. Knowing that the current topology is a 4 by 4 matrix, the system concludes that the door to which DCU2.3 is attached is open. Since this door is authorized to be open, the event is logged but the alarm is not sounded. |
| 98. | DCU1.3 | DCU1.2 | NBIO 0 |
| 99. | DCU1.2 | DCU2.2 | ARE YOU THERE? |
| 100. | DCU2.2 | DCU1.2 | YES |
| 101. | DCU1.2 | DCU1.1 | NBIO 2 |
| 102. | DCU1.1 | DCU2.1 | ARE YOU THERE? |
| 103. | DCU2.1 | DCU1.1 | YES |
| 104. | DCU1.1 | ECU1 | NBIO 3 |
| | | | |
| 105. | ECU1 | SCU | NBIO 4,0 |
| 106. | ECU1 | SCU | ENDP 3 |
| 107. | SCU | System | ENDP 3; The system interprets this to mean that the polling of 4 columns has been completed. Knowing that the current topology is a 4 by 4 matrix, the system does not sound the alarm. |

Case 3 - A single Unauthorized Door is Open

The door to which DCU2.3 is attached is open. This door has not been authorized to be open.

| | SOURCE | DEST. | MESSAGE CONTENTS |
|---|---|---|---|
| 1. | System | SCU | POLL |
| 2. | SCU | Right Link | POLL (Transmission fails) |
| 3. | SCU | ECU1 | POLL |
| | | | |
| 4. | ECU1 | ECU2 | POLL |
| 5. | ECU2 | ECU3 | POLL |
| 6. | ECU3 | ECU4 | POLL |
| 7. | ECU4 | Next ECU | POLL (Transmission fails) |
| | | | |
| 8. | ECU4 | DCU4.1 | POLL |
| 9. | DCU4.1 | DCU4.2 | POLL |
| 10. | DCU4.2 | DCU4.3 | POLL |
| 11. | DCU4.3 | DCU4.4 | POLL |
| 12. | DCU4.4 | Next DCU | POLL (Transmission fails) |
| | | | |
| 13. | DCU4.4 | DCU3.4 | ARE YOU THERE? |
| 14. | DCU3.4 | DCU4.4 | YES |
| 15. | DCU4.4 | DCU4.3 | NBIO 0 |
| 16. | DCU4.3 | DCU3.3 | ARE YOU THERE? |
| 17. | DCU3.3 | DCU4.3 | YES |
| 18. | DCU4.3 | DCU4.2 | NBIO 1 |
| 19. | DCU4.2 | DCU3.2 | ARE YOU THERE? |
| 20. | DCU3.2 | DCU4.2 | YES |
| 21. | DCU4.2 | DCU4.1 | NBIO 2 |
| 22. | DCU4.1 | DCU3.1 | ARE YOU THERE? |
| 23. | DCU3.1 | DCU4.1 | YES |
| 24. | DCU4.1 | ECU4 | NBIO 3 |
| | | | |
| 25. | ECU4 | ECU3 | NBIO 4,0 |
| 26. | ECU3 | ECU2 | NBIO 4,1 |
| 27. | ECU2 | ECU1 | NBIO 4,2 |
| 28. | ECU1 | SCU | NBIO 4,3 |
| 29. | SCU | System | NBIO 4,3; The system interprets this to mean that DCU3.4 could not communicate with the DCU above it. Knowing that the current topology is a 4 by 4 matrix, the system does not sound the alarm. |
| 30. | ECU4 | ECU3 | ENDP 0 |
| | | | |
| 31. | ECU3 | DCU3.1 | POLL |
| 32. | DCU3.1 | DCU3.2 | POLL |
| 33. | DCU3.2 | DCU3.3 | POLL |
| 34. | DCU3.3 | DCU3.4 | POLL |
| 35. | DCU3.4 | Next DCU | POLL (Transmission fails) |
| | | | |

| | | | |
|---|---|---|---|
| 36. | DCU3.4 | DCU4.4 | ARE YOU THERE? |
| 37. | DCU4.4 | DCU3.4 | YES |
| 38. | DCU3.4 | DCU2.4 | ARE YOU THERE? |
| 39. | DCU2.4 | DCU3.4 | YES |
| 40. | DCU3.4 | DCU3.3 | NBIO 0 |
| 41. | DCU3.3 | DCU4.3 | ARE YOU THERE? |
| 42. | DCU4.3 | DCU3.3 | YES |
| 43. | DCU3.3 | DCU2.3 | ARE YOU THERE? (Transmission fails) |
| 44. | DCU3.3 | DCU3.2 | RBIO 0 |
| 45. | DCU3.2 | DCU3.1 | RBIO 1 |
| 46. | DCU3.1 | ECU3 | RBIO 2 |
| 47. | ECU3 | ECU2 | RBIO 3,0 |
| 48. | ECU2 | ECU1 | RBIO 3,1 |
| 49. | ECU1 | SCU | RBIO 3,2 |
| 50. | SCU | System | RBIO 3,2; The system interprets this to mean that DCU3.3 could not communicate with the DCU to its right. Knowing that the current topology is a 4 by 4 matrix, the system concludes that the door to which DCU2.3 has been attached is open. Since this door is not authorized to open, the system logs the event and souds the alarm. |
| 51. | DCU3.3 | DCU3.2 | NBIO 1 |
| 52. | DCU3.2 | DCU4.2 | ARE YOU THERE? |
| 53. | DCU4.2 | DCU3.2 | YES |
| 54. | DCU3.2 | DCU2.2 | ARE YOU THERE? |
| 55. | DCU2.2 | DCU3.2 | YES |
| 56. | DCU3.2 | DCU3.1 | NBIO 2 |
| 57. | DCU3.1 | DCU4.1 | ARE YOU THERE? |
| 58. | DCU4.1 | DCU3.1 | YES |
| 59. | DCU3.1 | DCU2.1 | ARE YOU THERE? |
| 60. | DCU2.1 | DCU3.1 | YES |
| 61. | DCU3.1 | ECU3 | NBIO 3 |
| | | | |
| 62. | ECU3 | ECU2 | NBIO 4,0 |
| 63. | ECU2 | ECU1 | NBIO 4,1 |
| 64. | ECU1 | SCU | NBIO 4,2 |
| 65. | SCU | System | NBIO 4,2; The system interprets this to mean that DCU3.4 could not communicate with the DCU above it. Knowing that the current topology is a 4 by 4 matrix, the system does not sound the alarm. |
| 66. | ECU3 | ECU2 | ENDP 1 |
| | | | |
| 67. | ECU2 | DCU2.1 | POLL |
| 68. | DCU2.1 | DCU2.2 | POLL |
| 69. | DCU2.2 | DCU2.3 | POLL (Transmission fails) |
| | | | |
| 70. | DCU2.2 | DCU3.2 | ARE YOU THERE? |
| 71. | DCU3.2 | DCU2.2 | YES |
| 72. | DCU2.2 | DCU1.2 | ARE YOU THERE? |
| 73. | DCU1.2 | DCU2.2 | YES |
| 74. | DCU2.2 | DCU2.1 | NBIO 0 |

Sequences

| | | | |
|---|---|---|---|
| 75. | DCU2.1 | DCU3.1 | ARE YOU THERE? |
| 76. | DCU3.1 | DCU2.1 | YES |
| 77. | DCU2.1 | DCU1.1 | ARE YOU THERE? |
| 78. | DCU1.1 | DCU2.1 | YES |
| 79. | DCU2.1 | ECU2 | NBIO 1 |
| | | | |
| 80. | ECU2 | ECU1 | NBIO 2,0 |
| 81. | ECU1 | SCU | NBIO 2,1 |
| 82. | SCU | System | NBIO 2,1; The system interprets this to mean that DCU2.2 could not communicate with the DCU above it. Knowing that the current topology is a 4 by 4 matrix, the system concludes that the door to which DCU2.3 has been attached is open. Since this door is not authorized to open the system logs the event and sounds that alarm. |
| 83. | ECU2 | ECU1 | ENDP 2 |
| | | | |
| 84. | ECU1 | DCU1.1 | POLL |
| 85. | DCU1.1 | DCU1.2 | POLL |
| 86. | DCU1.2 | DCU1.3 | POLL |
| 87. | DCU1.3 | DCU1.4 | POLL |
| 88. | DCU1.4 | Next DCU | POLL (Transmission fails) |
| | | | |
| 89. | DCU1.4 | DCU2.4 | ARE YOU THERE? |
| 90. | DCU2.4 | DCU1.4 | YES |
| 91. | DCU1.4 | DCU1.3 | NBIO 0 |
| 92. | DCU1.3 | DCU2.3 | ARE YOU THERE? (Transmission fails) |
| 93. | DCU1.3 | DCU1.2 | LBIO 0 |
| 94. | DCU1.2 | DCU1.1 | LBIO 1 |
| 95. | DCU1.1 | ECU1 | LBIO 2 |
| 96. | ECU1 | SCU | LBIO 3,0 |
| 97. | SCU | System | LBIO 3,0; The system interprets this to mean that DCU1.3 could not communicate with the DCU to its left. Knowing that the current topology is a 4 by 4 matrix, the system concludes that the door to which DCU2.3 is attached is open. Since this door is not authorized to open, the system logs the event and sounds the alarm. |
| 98. | DCU1.3 | DCU1.2 | NBIO 0 |
| 99. | DCU1.2 | DCU2.2 | ARE YOU THERE? |
| 100. | DCU2.2 | DCU1.2 | YES |
| 101. | DCU1.2 | DCU1.1 | NBIO 2 |
| 102. | DCU1.1 | DCU2.1 | ARE YOU THERE? |
| 103. | DCU2.1 | DCU1.1 | YES |
| 104. | DCU1.1 | ECU1 | NBIO 3 |
| | | | |
| 105. | ECU1 | SCU | NBIO 4,0 |
| 106. | ECU1 | SCU | ENDP 3 |

| | | | |
|---|---|---|---|
| 107. | SCU | System | ENDP 3; The system interprets this to mean that the polling of 4 columns has been completed. Knowing that the current topology is a 4 by 4 matrix, the system does not sound the alarm. |

Case 4 - Two Doors Open

The door to which DCU2.3 is attached is open with authorization. The door to which DCU2.4 has been attached is open without authorization.

| | SOURCE | DEST. | MESSAGE CONTENTS |
|---|---|---|---|
| 1. | System | SCU | POLL |
| 2. | SCU | Right Link | POLL (Transmission fails) |
| 3. | SCU | ECU1 | POLL |
| | | | |
| 4. | ECU1 | ECU2 | POLL |
| 5. | ECU2 | ECU3 | POLL |
| 6. | ECU3 | ECU4 | POLL |
| 7. | ECU4 | Next ECU | POLL (Transmission fails) |
| | | | |
| 8. | ECU4 | DCU4.1 | POLL |
| 9. | DCU4.1 | DCU4.2 | POLL |
| 10. | DCU4.2 | DCU4.3 | POLL |
| 11. | DCU4.3 | DCU4.4 | POLL |
| 12. | DCU4.4 | Next DCU | POLL (Transmission fails) |
| | | | |
| 13. | DCU4.4 | DCU3.4 | ARE YOU THERE? |
| 14. | DCU3.4 | DCU4.4 | YES |
| 15. | DCU4.4 | DCU4.3 | NBIO 0 |
| 16. | DCU4.3 | DCU3.3 | ARE YOU THERE? |
| 17. | DCU3.3 | DCU4.3 | YES |
| 18. | DCU4.3 | DCU4.2 | NBIO 1 |
| 19. | DCU4.2 | DCU3.2 | ARE YOU THERE? |
| 20. | DCU3.2 | DCU4.2 | YES |
| 21. | DCU4.2 | DCU4.1 | NBIO 2 |
| 22. | DCU4.1 | DCU3.1 | ARE YOU THERE? |
| 23. | DCU3.1 | DCU4.1 | YES |
| 24. | DCU4.1 | ECU4 | NBIO 3 |
| | | | |
| 25. | ECU4 | ECU3 | NBIO 4,0 |
| 26. | ECU3 | ECU2 | NBIO 4,1 |
| 27. | ECU2 | ECU1 | NBIO 4,2 |
| 28. | ECU1 | SCU | NBIO 4,3 |
| 29. | SCU | System | NBIO 4,3; The system interprets this to mean that DCU4.4 could not communicate with the DCU above it. Knowing that the current topology is a 4 by 4 matrix, the system does not sound the alarm. |
| 30. | ECU4 | ECU3 | ENDP 0 |
| | | | |
| 31. | ECU3 | DCU3.1 | POLL |
| 32. | DCU3.1 | DCU3.2 | POLL |
| 33. | DCU3.2 | DCU3.3 | POLL |
| 34. | DCU3.3 | DCU3.4 | POLL |
| 35. | DCU3.4 | Next DCU | POLL (Transmission fails) |
| | | | |
| 36. | DCU3.4 | DCU4.4 | ARE YOU THERE? |

| | | | |
|---|---|---|---|
| 37. | DCU4.4 | DCU3.4 | YES |
| 38. | DCU3.4 | DCU2.4 | ARE YOU THERE? (Transmission fails) |
| 39. | DCU3.4 | DCU3.3 | RBIO 0 |
| 40. | DCU3.3 | DCU3.2 | RBIO 1 |
| 41. | DCU3.2 | DCU3.1 | RBIO 2 |
| 42. | DCU3.1 | ECU3 | RBIO 3 |
| 43. | ECU3 | ECU2 | RBIO 4,0 |
| 44. | ECU2 | ECU1 | RBIO 4,1 |
| 45. | ECU1 | SCU | RBIO 4,2 |
| 46. | SCU | System | RBIO 4,2; The system interprets this to mean that DCU3.4 could not communicate with the DCU to its right. Knowing that the current topology is a 4 by 4 matrix, the system concludes that the door to which DCU2.4 is attached is open. Since this door is not authorized to be open, the event is logged and the alarm is sounded. |
| 47. | DCU3.4 | DCU3.3 | NBIO 0 |
| 48. | DCU3.3 | DCU4.3 | ARE YOU THERE? |
| 49. | DCU4.3 | DCU3.3 | YES |
| 50. | DCU3.3 | DCU2.3 | ARE YOU THERE? (Transmission fails) |
| 51. | DCU3.3 | DCU3.2 | RBIO 0 |
| 52. | DCU3.2 | DCU3.1 | RBIO 1 |
| 53. | DCU3.1 | ECU3 | RBIO 2 |
| 54. | ECU3 | ECU2 | RBIO 3,0 |
| 55. | ECU2 | ECU1 | RBIO 3,1 |
| 56. | ECU1 | SCU | RBIO 3,2 |
| 57. | SCU | System | RBIO 3,2; The system interprets this to mean that DCU3.3 could not communicate with the DCU to its right. Knowing that the current topology is a 4 by 4 matrix, the system concludes that the door to which DCU2.3 is attached is open. Because this door is authorized to open, the system logs the event but does not sound the alarm. |
| 58. | DCU3.3 | DCU3.2 | NBIO 1 |
| 59. | DCU3.2 | DCU4.2 | ARE YOU THERE? |
| 60. | DCU4.2 | DCU3.2 | YES |
| 61. | DCU3.2 | DCU2.2 | ARE YOU THERE? |
| 62. | DCU2.2 | DCU3.2 | YES |
| 63. | DCU3.2 | DCU3.1 | NBIO 2 |
| 64. | DCU3.1 | DCU4.1 | ARE YOU THERE? |
| 65. | DCU4.1 | DCU3.1 | YES |
| 66. | DCU3.1 | DCU2.1 | ARE YOU THERE? |
| 67. | DCU2.1 | DCU3.1 | YES |
| 68. | DCU3.1 | ECU3 | NBIO 3 |
| | | | |
| 69. | ECU3 | ECU2 | NBIO 4,0 |
| 70. | ECU2 | ECU1 | NBIO 4,1 |
| 71. | ECU1 | SCU | NBIO 4,2 |

| | | | |
|---|---|---|---|
| 72. | SCU | System | NBIO 4,2; The system interprets this to mean that DCU3.4 could not communicate with the DCU above it. Knowing that the current topology is a 4 by 4 matrix, the system does not sound the alarm. |
| 73. | ECU3 | ECU2 | ENDP 1 |
| | | | |
| 74. | ECU2 | DCU2.1 | POLL |
| 75. | DCU2.1 | DCU2.2 | POLL |
| 76. | DCU2.2 | DCU2.3 | POLL (Transmission fails) |
| | | | |
| 77. | DCU2.2 | DCU3.2 | ARE YOU THERE? |
| 78. | DCU3.2 | DCU2.2 | YES |
| 79. | DCU2.2 | DCU1.2 | ARE YOU THERE? |
| 80. | DCU1.2 | DCU2.2 | YES |
| 81. | DCU2.2 | DCU2.1 | NBIO 0 |
| 82. | DCU2.1 | DCU3.1 | ARE YOU THERE? |
| 83. | DCU3.1 | DCU2.1 | YES |
| 84. | DCU2.1 | DCU1.1 | ARE YOU THERE? |
| 85. | DCU1.1 | DCU2.1 | YES |
| 86. | DCU2.1 | ECU2 | NBIO 1 |
| | | | |
| 87. | ECU2 | ECU1 | NBIO 2,0 |
| 88. | ECU1 | SCU | NBIO 2,1 |
| 89. | SCU | System | NBIO 2,1; The system interprets this to mean that DCU2.2 could not communicate with the DCU above it. Knowing that the current topology is a 4 by 4 matrix, the system concludes that the door to which DCU2.3 is attached is open. Since this door is authorized to be open, the system logs the event but does not sound the alarm. |
| 90. | ECU2 | ECU2 | ENDP 1 |
| | | | |
| 91. | ECU1 | DCU1.1 | POLL |
| 92. | DCU1.1 | DCU1.2 | POLL |
| 93. | DCU1.2 | DCU1.3 | POLL |
| 94. | DCU1.3 | DCU1.4 | POLL |
| 95. | DCU1.4 | Next DCU | POLL (Transmission fails) |
| | | | |
| 96. | DCU1.4 | DCU2.4 | ARE YOU THERE? (Transmission fails) |
| 97. | DCU1.4 | DCU1.3 | LBIO 0 |
| 98. | DCU1.3 | DCU1.2 | LBIO 1 |
| 99. | DCU1.2 | DCU1.1 | LBIO 2 |
| 100. | DCU1.1 | ECU1 | LBIO 3 |
| 101. | ECU1 | SCU | LBIO 4,0 |
| 102. | SCU | System | LBIO 4,0; The system interprets this to mean that DCU1.4 could not communicate with the DCU to its right. Knowing that the current topology is a 4 by 4 matrix, the system concludes that the door to which DCU2.4 is attached is open. Since this door is not authorized to be open, the event is logged and the alarm is sounded. |

| | | | |
|---|---|---|---|
| 103. | DCU1.4 | DCU1.3 | NBIO 0 |
| 104. | DCU1.3 | DCU2.3 | ARE YOU THERE? (Transmission fails) |
| 105. | DCU1.3 | DCU1.2 | LBIO 0 |
| 106. | DCU1.2 | DCU1.1 | LBIO 1 |
| 107. | DCU1.1 | ECU1 | LBIO 2 |
| 108. | ECU1 | SCU | LBIO 3,0 |
| 109. | SCU | System | LBIO 3,0; The system interprets this to mean that DCU1.3 could not communicate with the DCU to its left. Knowing that the current topology is a 4 by 4 matrix, the system concludes that the door to which DCU2.3 is attached is open. Since this door is authorized to be open, the event is logged but the alarm is not sounded. |
| 110. | DCU1.3 | DCU1.2 | NBIO 0 |
| 111. | DCU1.2 | DCU2.2 | ARE YOU THERE? |
| 112. | DCU2.2 | DCU1.2 | YES |
| 113. | DCU1.2 | DCU1.1 | NBIO 2 |
| 114. | DCU1.1 | DCU2.1 | ARE YOU THERE? |
| 115. | DCU2.1 | DCU1.1 | YES |
| 116. | DCU1.1 | ECU1 | NBIO 3 |
| | | | |
| 117. | ECU1 | SCU | NBIO 4,0 |
| 118. | SCU | System | NBIO 3,0; The system interprets this to mean that DCU1.4 could not communicate with the DCU above it. Knowing that the current topology is a 4 by 4 matrix, the system does not sound the alarm. |
| 119. | ECU1 | SCU | ENDP 3 |
| 120. | SCU | System | ENDP 3; The system interprets this to mean that the polling of 4 columns has been completed. Knowing that the current topology is a 4 by 4 matrix, the system does not sound the alarm. |

We claim:

1. A system for monitoring a multiplicity of doors comprising:

at least two optical transceivers mounted on each of the multiplicity of doors; and communication apparatus for communicating with said at least two optical transceivers mounted on each of the multiplicity of doors thereby to verify their positions, said communication apparatus being operative to communicate with at least two optical transceivers on each of said multiplicity of doors via plural serial communications pathways, at least one of said plural pathways extending via optical transceivers mounted on a plurality of different doors.

2. A system according to claim 1 and wherein said at least two optical transceivers comprise a plurality of optical transmitters and receivers operative in a plurality of different directions.

3. A system according to claim 1 and wherein said at least two optical transceivers on each of said plurality of doors are autonomously powered.

4. A system according to claim 1 and wherein said at least two optical transceivers each comprise at least one light emitting diode and light sensor.

5. A system according to claim 1 and wherein said at least two optical transceivers are operative to provide an indication of an open door or inoperative transceiver downstream thereof in a communications chain.

6. A system according to claim 1 and wherein said communications apparatus comprises a personal computer.

7. A system according to claim 1 and wherein said communications apparatus communicates with said at least two optical transceivers via at least two communications interfaces.

8. A system according to claim 1 and wherein said plurality of doors are doors of a bank of safe deposit boxes.

9. A system according to claim 1 and also comprising apparatus for logging door openings and inoperative transceivers on a time based log.

* * * * *